US010731095B2

(12) United States Patent
Senior et al.

(10) Patent No.: US 10,731,095 B2
(45) Date of Patent: Aug. 4, 2020

(54) PROCESS TO REDUCE EMISSIONS OF NITROGEN OXIDES AND MERCURY FROM COAL-FIRED BOILERS

(71) Applicant: ADA-ES, Inc., Highlands Ranch, CO (US)

(72) Inventors: Constance Senior, Littleton, CO (US); Gregory M. Filippelli, Catonsville, MD (US); Cynthia Jean Bustard, Littleton, CO (US); Michael D. Durham, Castle Rock, CO (US); William J. Morris, Evergreen, CO (US); Sharon M. Sjostrom, Sedalia, CO (US)

(73) Assignee: ADA-ES, Inc., Highlands Ranch, CO (US)

( * ) Notice: Subject to any disclaimer, the term of this patent is extended or adjusted under 35 U.S.C. 154(b) by 0 days.

(21) Appl. No.: 16/590,178

(22) Filed: Oct. 1, 2019

(65) Prior Publication Data

US 2020/0071629 A1 Mar. 5, 2020

Related U.S. Application Data

(60) Continuation of application No. 15/812,993, filed on Nov. 14, 2017, now Pat. No. 10,465,137, which is a continuation of application No. 14/958,327, filed on Dec. 3, 2015, now Pat. No. 9,850,442, which is a continuation of application No. 14/484,001, filed on Sep. 11, 2014, now Pat. No. 9,238,782, which is a division of application No. 13/471,015, filed on May 14, 2012, now Pat. No. 8,845,986.

(60) Provisional application No. 61/543,196, filed on Oct. 4, 2011, provisional application No. 61/486,217, filed on May 13, 2011.

(51) Int. Cl.

| | |
|---|---|
| ***C10L 10/02*** | (2006.01) |
| ***F23J 7/00*** | (2006.01) |
| ***F23J 15/00*** | (2006.01) |
| ***C10L 9/10*** | (2006.01) |
| ***C10L 5/04*** | (2006.01) |

(52) U.S. Cl.

CPC ..... *C10L 10/02* (2013.01); *C10L 5/04* (2013.01); *C10L 9/10* (2013.01); *F23J 7/00* (2013.01); *F23J 15/003* (2013.01); *C10L 2200/025* (2013.01); *C10L 2200/0259* (2013.01); *F23K 2201/505* (2013.01); *Y10T 428/2982* (2015.01)

(58) Field of Classification Search

CPC ..... C10L 5/00; C10L 5/04; C10L 5/26; C10L 5/32; C10L 10/00; C10L 10/04; C10L 2230/02; C10L 2230/04; C10L 2230/08; C10L 2230/088; C10L 2290/20; C10L 2290/22; F23C 13/00; B01D 53/56; B01D 53/565; B01D 2251/20; B01D 2252/20; B01D 2252/204; B01D 2252/60; B01D 2257/402; B01D 2257/404; B01D 2258/0283; B01J 20/3231; B01J 20/3234; F23J 7/00; F23J 15/003; F23J 2201/505

See application file for complete search history.

(56) References Cited

U.S. PATENT DOCUMENTS

| | | | |
|---|---|---|---|
| 208,011 | A | 9/1878 | Eaton |
| 224,649 | A | 2/1880 | Child |
| 346,765 | A | 8/1886 | McIntyre |
| 367,014 | A | 7/1887 | Wandrey et al. |
| 537,998 | A | 4/1895 | Spring et al. |
| 541,025 | A | 6/1895 | Gray |
| 685,719 | A | 10/1901 | Harris |
| 700,888 | A | 5/1902 | Battistini |
| 744,908 | A | 11/1903 | Dallas |
| 846,338 | A | 3/1907 | McNamara |
| 894,110 | A | 7/1908 | Bloss |
| 896,875 | A | 8/1908 | Williams |
| 896,876 | A | 8/1908 | Williams |
| 911,960 | A | 2/1909 | Ellis |
| 1,112,547 | A | 10/1914 | Morin |
| 1,183,445 | A | 5/1916 | Foxwell |
| 1,984,164 | A | 12/1934 | Stock |
| 2,059,388 | A | 11/1936 | Nelms |
| 2,077,298 | A | 4/1937 | Zelger |
| 2,089,599 | A | 8/1937 | Crecelius |
| 2,511,288 | A | 6/1950 | Morrell et al. |
| 3,194,629 | A | 7/1965 | Dreibelbis et al. |
| 3,599,610 | A | 8/1971 | Spector |
| 3,662,523 | A | 5/1972 | Revoir et al. |
| 3,725,530 | A | 4/1973 | Kawase et al. |
| 3,754,074 | A | 8/1973 | Grantham |
| 3,764,496 | A | 10/1973 | Hultman et al. |
| 3,786,619 | A | 1/1974 | Melkersson et al. |
| 3,803,803 | A | 4/1974 | Raduly et al. |
| 3,823,676 | A | 7/1974 | Cook et al. |

(Continued)

FOREIGN PATENT DOCUMENTS

| | | |
|---|---|---|
| CA | 1067835 | 12/1979 |
| CA | 1099490 | 4/1981 |

(Continued)

OTHER PUBLICATIONS

U.S. Appl. No. 16/503,239, filed Jul. 3, 2019, Sjostrom et al.

(Continued)

*Primary Examiner* — Timothy C Vanoy

(74) *Attorney, Agent, or Firm* — Sheridan Ross P.C.

(57) ABSTRACT

A flue gas additive is provided that includes both a nitrogenous component to reduce gas phase nitrogen oxides and a halogen-containing component to oxidize gas phase elemental mercury.

24 Claims, 7 Drawing Sheets

(56) References Cited

U.S. PATENT DOCUMENTS 3,826,618 A 7/1974 Capuano
3,838,190 A 9/1974 Birke et al.
3,849,267 A 11/1974 Hilgen et al.
3,849,537 A 11/1974 Allgulin
3,851,042 A 11/1974 Minnick
3,876,393 A 4/1975 Kasai et al.
3,956,458 A 5/1976 Anderson
3,961,020 A 6/1976 Seki
3,974,254 A 8/1976 de la Cuadra Herra et al.
4,075,282 A 2/1978 Storp et al.
4,094,777 A 6/1978 Sugier et al.
4,101,631 A 7/1978 Ambrosini et al.
4,115,518 A 9/1978 Delmon et al.
4,140,654 A * 2/1979 Yoshioka ..... B01D 53/9418 423/239.1
4,148,613 A 4/1979 Myers
4,174,373 A 11/1979 Yoshida et al.
4,196,173 A 4/1980 Dejong et al.
4,212,853 A 7/1980 Fukui
4,233,274 A 11/1980 Allgulin
4,262,610 A 4/1981 Hein et al.
4,273,747 A 6/1981 Rasmussen
4,342,192 A 8/1982 Heyn et al.
4,387,653 A 6/1983 Voss
4,427,630 A 1/1984 Aibe et al.
4,440,100 A 4/1984 Michelfelder et al.
4,474,896 A 10/1984 Chao
4,500,327 A 2/1985 Nishino et al.
4,503,785 A 3/1985 Scocca
4,519,995 A 5/1985 Schrofelbauer et al.
4,555,392 A 11/1985 Steinberg
4,578,256 A 3/1986 Nishino et al.
4,626,418 A 12/1986 College et al.
4,678,481 A 7/1987 Diep
4,693,731 A 9/1987 Tarakad et al.
4,708,853 A 11/1987 Matviya et al.
4,729,882 A 3/1988 Ide et al.
4,741,278 A 5/1988 Franke et al.
4,751,065 A 6/1988 Bowers
4,758,371 A 7/1988 Bhatia
4,758,418 A 7/1988 Yoo et al.
4,772,455 A 9/1988 Izumi et al.
4,779,207 A 10/1988 Woracek et al.
4,786,483 A 11/1988 Audeh
4,803,059 A 2/1989 Sullivan et al.
4,804,521 A 2/1989 Rochelle et al.
4,807,542 A 2/1989 Dykema
4,814,152 A 3/1989 Yan
4,820,318 A 4/1989 Chang et al.
4,824,441 A 4/1989 Kindig
4,830,829 A 5/1989 Craig, Jr.
4,873,930 A 10/1989 Egense et al.
4,876,025 A 10/1989 Roydhouse
4,886,519 A 12/1989 Hayes et al.
4,889,698 A 12/1989 Moller et al.
4,892,567 A 1/1990 Yan
4,915,818 A 4/1990 Yan
4,917,862 A 4/1990 Kraw et al.
4,936,047 A 6/1990 Feldmann et al.
4,956,162 A 9/1990 Smith et al.
4,964,889 A 10/1990 Chao
5,013,358 A 5/1991 Ball et al.
5,024,171 A 6/1991 Krigmont et al.
5,047,219 A 9/1991 Epperly et al.
5,049,163 A 9/1991 Huang et al.
5,116,793 A 5/1992 Chao et al.
5,120,516 A 6/1992 Ham et al.
5,122,353 A 6/1992 Valentine
5,124,135 A 6/1992 Girrbach et al.
5,126,300 A 6/1992 Pinnavaia et al.
5,202,301 A 4/1993 McNamara
5,238,488 A 8/1993 Wilhelm
5,245,120 A 9/1993 Srinivasachar et al.
5,277,135 A 1/1994 Dubin
5,288,306 A 2/1994 Aibe et al.
5,300,137 A 4/1994 Weyand et al.
5,320,817 A 6/1994 Hardwick et al.
5,328,673 A 7/1994 Kaczur et al.
5,336,835 A 8/1994 McNamara
5,346,674 A 9/1994 Weinwurm et al.
5,350,728 A 9/1994 Cameron et al.
5,352,647 A 10/1994 Suchenwirth
5,354,363 A 10/1994 Brown, Jr. et al.
5,356,611 A 10/1994 Herkelmann et al.
5,368,617 A 11/1994 Kindig
5,403,548 A 4/1995 Aibe et al.
5,409,522 A 4/1995 Durham et al.
5,419,834 A 5/1995 Straten
5,435,843 A 7/1995 Roy et al.
5,435,980 A 7/1995 Felsvang et al.
5,447,703 A 9/1995 Baer et al.
5,460,643 A 10/1995 Hasenpusch et al.
5,480,619 A 1/1996 Johnson et al.
5,499,587 A 3/1996 Rodriquez et al.
5,502,021 A 3/1996 Schuster
5,505,746 A 4/1996 Chriswell et al.
5,505,766 A 4/1996 Chang
5,520,898 A 5/1996 Pinnavaia et al.
5,569,436 A 10/1996 Lerner
5,571,490 A 11/1996 Bronicki et al.
5,575,982 A 11/1996 Reiss et al.
5,587,003 A 12/1996 Bulow et al.
5,607,496 A 3/1997 Brooks
5,607,654 A 3/1997 Lerner
5,618,508 A 4/1997 Suchenwirth et al.
5,635,150 A 6/1997 Coughlin
5,648,508 A 7/1997 Yaghi
5,670,122 A 9/1997 Zamansky et al.
5,672,323 A 9/1997 Bhat et al.
5,674,459 A 10/1997 Gohara et al.
5,679,957 A 10/1997 Durham et al.
5,695,726 A 12/1997 Lerner
5,733,360 A 3/1998 Feldman et al.
5,733,516 A 3/1998 DeBerry
5,738,834 A 4/1998 DeBerry
5,744,109 A 4/1998 Sitges Menendez et al.
5,785,932 A 7/1998 Helfritch
5,787,823 A 8/1998 Knowles
5,809,910 A 9/1998 Svendssen
5,809,911 A 9/1998 Feizollahi
5,810,910 A 9/1998 Ludwig et al.
5,827,352 A 10/1998 Altman et al.
5,871,703 A 2/1999 Alix et al.
5,875,722 A 3/1999 Gosselin et al.
5,891,324 A 4/1999 Ohtsuka
5,897,688 A 4/1999 Voogt et al.
5,900,042 A 5/1999 Mendelsohn et al.
5,910,292 A 6/1999 Alvarez, Jr. et al.
5,989,506 A 11/1999 Markovs
6,001,152 A 12/1999 Sinha
6,013,593 A 1/2000 Lee et al.
6,024,931 A 2/2000 Hanulik
6,027,551 A 2/2000 Hwang et al.
6,080,281 A 6/2000 Attia
6,083,403 A 7/2000 Tang
6,117,403 A 9/2000 Alix et al.
6,132,692 A 10/2000 Alix et al.
6,136,072 A 10/2000 Sjostrom et al.
6,136,281 A 10/2000 Meischen et al.
6,136,749 A 10/2000 Gadkaree
6,202,574 B1 3/2001 Liljedahl et al.
6,214,304 B1 4/2001 Rosenthal et al.
6,231,643 B1 5/2001 Pasic et al.
6,248,217 B1 6/2001 Biswas et al.
6,250,235 B1 6/2001 Oehr et al.
6,258,334 B1 7/2001 Gadkaree et al.
6,284,199 B1 9/2001 Downs et al.
6,284,208 B1 9/2001 Thomassen
6,294,139 B1 9/2001 Vicard et al.
6,328,939 B1 12/2001 Amrhein
6,348,178 B1 2/2002 Sudduth et al.
6,368,511 B1 4/2002 Weissenberg et al.
6,372,187 B1 4/2002 Madden et al.
6,375,909 B1 4/2002 Dangtran et al.

(56) References Cited

U.S. PATENT DOCUMENTS 6,383,981 B1 5/2002 Blakenship et al.
6,447,740 B1 9/2002 Caldwell et al.
6,475,451 B1 11/2002 Leppin et al.
6,521,021 B1 2/2003 Pennline et al.
6,524,371 B2 2/2003 El-Shoubary et al.
6,528,030 B2 3/2003 Madden et al.
6,533,842 B1 3/2003 Maes et al.
6,558,454 B1 5/2003 Chang et al.
6,576,585 B2 6/2003 Fischer et al.
6,582,497 B1 6/2003 Maes et al.
6,589,318 B2 7/2003 El-Shoubary et al.
6,610,263 B2 8/2003 Pahlman et al.
6,638,347 B2 10/2003 El-Shoubary et al.
6,638,485 B1 10/2003 Iida et al.
6,649,082 B2 11/2003 Hayasaka et al.
6,682,709 B2 1/2004 Sudduth et al.
6,694,900 B2 2/2004 Lissianski et al.
6,702,569 B2 3/2004 Kobayashi et al.
6,719,828 B1 4/2004 Lovell et al.
6,726,888 B2 4/2004 Lanier et al.
6,729,248 B2 5/2004 Johnson et al.
6,732,055 B2 5/2004 Bagepalli et al.
6,737,031 B2 5/2004 Beal et al.
6,773,471 B2 8/2004 Johnson et al.
6,787,742 B2 9/2004 Kansa et al.
6,790,420 B2 9/2004 Breen et al.
6,808,692 B2 10/2004 Oehr
6,818,043 B1 11/2004 Chang et al.
6,827,837 B2 12/2004 Minter
6,841,513 B2 1/2005 El-Shoubary et al.
6,848,374 B2 2/2005 Srinivasachar et al.
6,855,859 B2 2/2005 Nolan et al.
6,860,911 B2 3/2005 Hundley
6,878,358 B2 4/2005 Vosteen et al.
6,883,444 B2 4/2005 Logan et al.
6,916,762 B2 7/2005 Shibuya et al.
6,942,840 B1 9/2005 Broderick
6,945,925 B2 9/2005 Pooler et al.
6,953,494 B2 10/2005 Nelson, Jr.
6,960,329 B2 11/2005 Sellakumar
6,962,617 B2 11/2005 Simpson
6,969,494 B2 11/2005 Herbst
6,972,120 B2 12/2005 Holste et al.
6,974,564 B2 12/2005 Biermann
6,975,975 B2 12/2005 Fasca
7,008,603 B2 3/2006 Brooks et al.
7,013,817 B2 3/2006 Stowe, Jr. et al.
7,017,330 B2 3/2006 Bellows
7,111,591 B2 9/2006 Schwab et al.
7,118,720 B1 10/2006 Mendelsohn et al.
7,141,091 B2 11/2006 Chang
7,153,481 B2 12/2006 Bengtsson et al.
7,156,959 B2 1/2007 Herbst
7,198,769 B2 4/2007 Cichanowicz
7,211,707 B2 5/2007 Axtell et al.
7,217,401 B2 5/2007 Ramme et al.
7,250,387 B2 7/2007 Durante et al.
7,270,063 B2 9/2007 Aradi et al.
7,332,002 B2 2/2008 Johnson et al.
7,361,209 B1 4/2008 Durham et al.
7,381,380 B2 6/2008 Herbst
7,381,387 B2 6/2008 Lissianski et al.
7,381,388 B2 6/2008 Cooper et al.
7,384,615 B2 6/2008 Boardman et al.
7,413,719 B2 8/2008 Digdon
7,416,137 B2 8/2008 Hagen et al.
7,430,969 B2 10/2008 Stowe, Jr. et al.
7,435,286 B2 10/2008 Olson et al.
7,442,239 B2 10/2008 Armstrong et al.
7,452,392 B2 11/2008 Nick et al.
7,468,170 B2 12/2008 Comrie
7,473,303 B1 1/2009 Higgins et al.
7,479,215 B2 1/2009 Carson et al.
7,479,263 B2 1/2009 Chang et al.
7,494,632 B1 2/2009 Klunder
7,497,076 B2 3/2009 Funk et al.
7,507,083 B2 3/2009 Comrie
7,514,052 B2 4/2009 Lissianski et al.
7,514,053 B2 4/2009 Johnson et al.
7,517,511 B2 4/2009 Schofield
7,521,032 B2 4/2009 Honjo et al.
7,524,473 B2 4/2009 Lindau et al.
7,544,338 B2 6/2009 Honjo et al.
7,544,339 B2 6/2009 Lissianski et al.
7,563,311 B2 7/2009 Graham
7,611,564 B2 11/2009 McChesney et al.
7,615,101 B2 11/2009 Holmes et al.
7,622,092 B2 11/2009 Honjo et al.
7,651,541 B2 * 1/2010 Hundley ..... B01F 17/0028 44/301
7,674,442 B2 3/2010 Comrie
7,712,306 B2 5/2010 White et al.
7,713,503 B2 5/2010 Maly et al.
7,722,843 B1 5/2010 Srinivasachar
7,727,307 B2 6/2010 Winkler
7,758,827 B2 7/2010 Comrie
7,767,174 B2 8/2010 Liu et al.
7,776,301 B2 8/2010 Comrie
7,780,765 B2 8/2010 Srinivasachar et al.
7,862,630 B2 * 1/2011 Hundley ..... B01D 53/502 44/457
7,906,090 B2 3/2011 Ukai et al.
7,938,571 B1 5/2011 Irvine
7,955,577 B2 6/2011 Comrie
7,988,939 B2 8/2011 Comrie
8,007,749 B2 8/2011 Chang et al.
8,017,550 B2 9/2011 Chao et al.
8,069,797 B2 12/2011 Srinivasachar et al.
8,071,060 B2 12/2011 Ukai et al.
8,080,088 B1 12/2011 Srinivasachar
8,101,144 B2 1/2012 Sasson et al.
8,124,036 B1 2/2012 Baldrey et al.
8,168,149 B2 5/2012 Gal et al.
8,216,535 B2 7/2012 Pollack et al.
8,226,913 B2 7/2012 Comrie
8,293,196 B1 10/2012 Baldrey et al.
8,303,919 B2 11/2012 Gadgil et al.
8,312,822 B2 11/2012 Holmes et al.
8,313,323 B2 11/2012 Comrie
8,372,362 B2 2/2013 Durham et al.
8,481,455 B1 7/2013 Jain et al.
8,496,894 B2 7/2013 Durham et al.
8,524,179 B2 9/2013 Durham et al.
8,574,324 B2 11/2013 Comrie
8,652,235 B2 2/2014 Olson et al.
8,663,594 B2 3/2014 Kawamura et al.
8,807,056 B2 8/2014 Holmes et al.
8,845,986 B2 9/2014 Senior et al.
8,865,099 B1 10/2014 Gray et al.
8,883,099 B2 11/2014 Sjostrom et al.
8,919,266 B2 12/2014 Johnson et al.
8,951,487 B2 2/2015 Durham et al.
8,980,207 B1 3/2015 Gray et al.
9,221,013 B2 12/2015 Sjostrom et al.
9,238,782 B2 1/2016 Senior et al.
9,308,493 B2 4/2016 Filippelli et al.
9,352,275 B2 5/2016 Durham et al.
9,409,123 B2 8/2016 Sjostrom et al.
9,416,967 B2 8/2016 Comrie
9,555,369 B2 1/2017 Moore et al.
9,657,942 B2 5/2017 Durham et al.
9,822,973 B2 11/2017 Comrie
9,850,442 B2 12/2017 Senior et al.
9,884,286 B2 2/2018 Sjostrom
9,889,405 B2 2/2018 Sjostrom et al.
9,889,451 B2 2/2018 Filippelli et al.
9,957,454 B2 * 5/2018 Morris ..... C10L 5/32
1,012,429 A1 11/2018 Durham et al.
1,015,993 A1 12/2018 Sjostrom et al.
1,042,709 A1 10/2019 Sjostrom et al.
1,046,513 A1 11/2019 Senior et al.
2002/0037246 A1 3/2002 Beal et al.
2002/0066394 A1 6/2002 Johnson et al.
2002/0068030 A1 6/2002 Nolan et al.

(56) References Cited

U.S. PATENT DOCUMENTS

2002/0088170 A1 7/2002 Sanyal
2002/0114749 A1 8/2002 Cole
2002/0134242 A1 9/2002 Yang et al.
2002/0150516 A1 10/2002 Pahlman
2002/0184817 A1 12/2002 Johnson et al.
2003/0065236 A1 4/2003 Vosteen et al.
2003/0099585 A1 5/2003 Allgulin
2003/0103882 A1 6/2003 Biermann et al.
2003/0104937 A1 6/2003 Sinha
2003/0164309 A1 9/2003 Nakamura et al.
2003/0166988 A1 9/2003 Hazen et al.
2003/0192234 A1 10/2003 Logan et al.
2003/0196578 A1 10/2003 Logan et al.
2003/0206843 A1 11/2003 Nelson, Jr.
2003/0206846 A1 11/2003 Jangbarwala
2003/0226312 A1 12/2003 Roos et al.
2004/0013589 A1 1/2004 Vosteen et al.
2004/0040438 A1 3/2004 Baldrey et al.
2004/0063210 A1 4/2004 Steichen et al.
2004/0076570 A1 4/2004 Jia
2004/0109800 A1 6/2004 Pahlman
2004/0129607 A1 7/2004 Slater et al.
2005/0019240 A1 1/2005 Lu et al.
2005/0026008 A1 2/2005 Heaton et al.
2005/0074380 A1 4/2005 Hammel et al.
2005/0147549 A1 7/2005 Lissianski et al.
2005/0169824 A1 8/2005 Downs et al.
2005/0227146 A1 10/2005 Ghantous et al.
2005/0260112 A1 11/2005 Hensman
2006/0027488 A1 2/2006 Gauthier
2006/0029531 A1 2/2006 Breen et al.
2006/0051270 A1 3/2006 Brunette
2006/0070561 A1* 4/2006 Stowe, Jr. ..... B01D 53/508 110/342
2006/0090678 A1 5/2006 Kriech
2006/0112823 A1 6/2006 Avin
2006/0124444 A1 6/2006 Nakamura et al.
2006/0185226 A1 8/2006 McDonald et al.
2006/0191835 A1 8/2006 Petrik et al.
2006/0205592 A1 9/2006 Chao et al.
2007/0140940 A1 6/2007 Varma et al.
2007/0156288 A1 7/2007 Wroblewski et al.
2007/0167309 A1 7/2007 Olson
2007/0168213 A1 7/2007 Comrie
2007/0179056 A1 8/2007 Baek et al.
2007/0180990 A1 8/2007 Downs et al.
2007/0184394 A1 8/2007 Comrie
2007/0234902 A1 10/2007 Fair et al.
2007/0281253 A1 12/2007 Toqan
2007/0295347 A1 12/2007 Paine et al.
2008/0017337 A1 1/2008 Duggirala
2008/0090951 A1 4/2008 Mao et al.
2008/0107579 A1 5/2008 Downs et al.
2008/0115704 A1 5/2008 Berry et al.
2008/0134888 A1 6/2008 Chao et al.
2008/0182747 A1 7/2008 Sinha
2008/0207443 A1 8/2008 Gadkaree et al.
2008/0292512 A1 11/2008 Kang
2009/0007785 A1 1/2009 Kimura et al.
2009/0031708 A1 2/2009 Schmidt
2009/0031929 A1 2/2009 Boardman et al.
2009/0062119 A1 3/2009 Olson et al.
2009/0081092 A1 3/2009 Yang et al.
2009/0104097 A1 4/2009 Dunson, Jr.
2009/0136401 A1 5/2009 Yang et al.
2009/0148372 A1 6/2009 Keiser
2009/0235848 A1 9/2009 Eiteneer et al.
2009/0287013 A1 11/2009 Morrison
2009/0320678 A1 12/2009 Chang et al.
2010/0025302 A1 2/2010 Sato et al.
2010/0047146 A1 2/2010 Olson et al.
2010/0189617 A1* 7/2010 Hundley ..... C10L 10/00 423/231
2010/0189618 A1 7/2010 White et al.
2011/0030592 A1 2/2011 Baldrey et al.
2011/0076210 A1 3/2011 Pollack et al.
2011/0168018 A1 7/2011 Mohamadalizadeh et al.
2011/0250111 A1 10/2011 Pollack et al.
2011/0262873 A1 10/2011 Nalepa et al.
2011/0281222 A1 11/2011 Comrie
2012/0100053 A1 4/2012 Durham et al.
2012/0100054 A1 4/2012 Durham et al.
2012/0124893 A1 5/2012 McRobbie et al.
2012/0183458 A1 7/2012 Olson et al.
2012/0216729 A1 8/2012 Baldrey et al.
2012/0272877 A1 11/2012 Comrie
2012/0311924 A1 12/2012 Richardson et al.
2013/0074745 A1 3/2013 Comrie
2013/0078169 A1 3/2013 LaFlesh et al.
2013/0139738 A1 6/2013 Grubbström et al.
2013/0280156 A1 10/2013 Olson et al.
2013/0312646 A1 11/2013 Comrie
2014/0030178 A1 1/2014 Martin
2014/0140908 A1 5/2014 Nalepa et al.
2014/0141380 A1 5/2014 Comrie
2014/0202069 A1 7/2014 Aradi et al.
2014/0213429 A1* 7/2014 Nochi ..... B01J 38/64 502/25
2014/0245936 A1 9/2014 Pollack et al.
2014/0271418 A1 9/2014 Keiser et al.
2014/0299028 A1 10/2014 Kotch et al.
2014/0308191 A1 10/2014 Mazyck et al.
2014/0341793 A1 11/2014 Holmes et al.
2015/0096480 A1 4/2015 Comrie
2016/0025337 A1 1/2016 Comrie
2016/0074808 A1 3/2016 Sjostrom et al.
2016/0166982 A1 6/2016 Holmes et al.
2016/0339385 A1 11/2016 Mimna et al.
2017/0050147 A1 2/2017 Denny et al.
2017/0292700 A1 10/2017 Comrie
2018/0117598 A1 5/2018 Filippelo et al.
2018/0223206 A1* 8/2018 Morris ..... C10L 5/32
2018/0224121 A1* 8/2018 Comrie ..... C10L 9/10
2019/0076781 A1 3/2019 Sjostrom et al.
2019/0118141 A1 4/2019 Durham et al.

FOREIGN PATENT DOCUMENTS

CA 2026056 3/1992
CA 2150529 12/1995
CA 2400898 8/2001
CA 2418578 8/2003
CA 2435474 1/2004
CA 2584327 4/2006
CA 2737281 4/2010
CN 1048173 1/1991
CN 1177628 4/1998
CN 1354230 6/2002
CN 1382657 12/2002
CN 1421515 6/2003
CN 1488423 4/2004
CN 101048218 10/2007
CN 101053820 10/2007
CN 101175550 5/2008
CN 101347722 A * 1/2009 ..... B01J 23/30
CN 101489647 7/2009
CN 101816922 9/2010
CN 102413899 4/2012
CN 105381680 3/2016
DE 3426059 1/1986
DE 3615759 11/1987
DE 3628963 3/1988
DE 3711503 10/1988
DE 3918292 4/1990
DE 4218672 8/1993
DE 4308388 10/1993
DE 4339777 5/1995
DE 4422661 1/1996
DE 19520127 12/1996
DE 19745191 4/1999
DE 19850054 5/2000
DE 10233173 7/2002
EP 0208036 1/1987
EP 0208490 1/1987

(56) References Cited

FOREIGN PATENT DOCUMENTS

| | | | | |
|---|---|---|---|---|
| EP | 0220075 | | 4/1987 | |
| EP | 0254697 | | 1/1988 | |
| EP | 0274132 | | 7/1988 | |
| EP | 0433677 | | 6/1991 | |
| EP | 0435848 | | 7/1991 | |
| EP | 0628341 | | 12/1994 | |
| EP | 0666098 | | 8/1995 | |
| EP | 0709128 | | 5/1996 | |
| EP | 0794240 | | 9/1997 | |
| EP | 0908217 | | 4/1999 | |
| EP | 1040865 | | 10/2000 | |
| EP | 1213046 | | 10/2001 | |
| EP | 1199354 | | 4/2002 | |
| EP | 1271053 | | 1/2003 | |
| EP | 1386655 | | 2/2004 | |
| EP | 1570894 | | 9/2005 | |
| EP | 1903092 | A3 * | 10/2010 | ..... C07C 233/18 |
| EP | 2452740 | | 5/2012 | |
| FR | 1394547 | | 4/1965 | |
| GB | 1121845 | | 7/1968 | |
| GB | 2122916 | | 1/1984 | |
| GB | 2441885 | | 3/2008 | |
| JP | 49-53591 | | 5/1974 | |
| JP | 49-53593 | | 5/1974 | |
| JP | 49-53594 | | 5/1974 | |
| JP | 59-10343 | | 1/1984 | |
| JP | 59-76537 | | 5/1984 | |
| JP | 59-160534 | | 9/1984 | |
| JP | 63-100918 | | 5/1988 | |
| JP | H02-303519 | | 12/1990 | |
| JP | H10-5537 | | 1/1998 | |
| JP | 10-109016 | | 4/1998 | |
| JP | 2000-197811 | | 7/2000 | |
| JP | 2000-205525 | | 7/2000 | |
| JP | 2000-325747 | | 11/2000 | |
| JP | 2001-347131 | | 12/2001 | |
| JP | 2003-065522 | | 3/2003 | |
| JP | 2004-066229 | | 3/2004 | |
| JP | 2005-230810 | | 9/2005 | |
| JP | 2010-005537 | | 1/2010 | |
| JP | 5064389 | | 10/2012 | |
| KR | 2004-0010276 | | 1/2004 | |
| KR | 100440845 | | 7/2004 | |
| RU | 2007-138432 | | 4/2009 | |
| RU | 2515988 | | 5/2014 | |
| RU | 2535684 | | 12/2014 | |
| WO | WO 96/14137 | | 5/1996 | |
| WO | WO 96/30318 | | 10/1996 | |
| WO | WO 97/44500 | | 11/1997 | |
| WO | WO 98/15357 | | 4/1998 | |
| WO | WO 99/58228 | | 11/1999 | |
| WO | WO 2001/38787 | | 5/2001 | |
| WO | WO 01/62368 | | 8/2001 | |
| WO | WO 02/28513 | | 4/2002 | |
| WO | WO 03/072241 | | 9/2003 | |
| WO | WO 2003/093518 | | 11/2003 | |
| WO | WO 2004/089501 | | 10/2004 | |
| WO | WO 2004/094024 | | 11/2004 | |
| WO | WO 2005/092477 | | 10/2005 | |
| WO | WO 2006/037213 | | 4/2006 | |
| WO | WO 2006/039007 | | 4/2006 | |
| WO | WO 2006/091635 | | 8/2006 | |
| WO | WO 2006/096993 | | 9/2006 | |
| WO | WO 2006/099611 | | 9/2006 | |
| WO | WO 2009/018539 | | 2/2009 | |
| WO | WO 2010/123609 | | 10/2010 | |
| ZA | 2003-05568 | | 7/2004 | |

OTHER PUBLICATIONS

"Continuous Emissions Monitors (CEMs): Field Studies of Dioxin/Furan CEMs," printed on Apr. 22, 2012, available at www.ejnet.org/toxics/cems/dioxin.html, 5 pages.

"DOE Announces Further Field Testing of Advanced Mercury Control Technologies, Six Projects Selected in Round 2 to Address Future Power Plant Mercury Reduction Initiatives," TECHNews From the National Energy Technology Laboratory, Nov. 5, 2004, available at http://www.netl.doe.gov/publications/TechNews/tn_mercury-control.html, printed on Jun. 3, 2009, pp. 1-2.

"Enhanced Mercury Control: KNX™ Coal Additive Technology," Alstom Power Inc., printed Aug. 3, 2006, 1 page.

"Evaluation of Sorbent Injection for Mercury Control at Great River Energy Coal Creek Station," ADA Environmental Solutions, Nov. 16-20, 2003 Final Report, Electric Power Research Institute, issued Mar. 3, 2004, 32 pages.

"Exclusive license agreement for an innovative mercury oxidation technology," Alstom Power Inc., printed Nov. 2, 2006, 1 page.

"Full-Scale Testing of Enhanced Mercury Control Technologies for Wet FGD Systems: Final Report for the Period Oct. 1, 2000 to Jun. 30, 2002," submitted by McDermott Technology, Inc., May 7, 2003, 151 pages.

"Gas Phase Filtration," Vaihtoilma White Air Oy, date unknown, 3 pages.

"Impregnated Activated Carbon," Products and Technologies Website, as early as 1999, available at http://www.calgoncarbon.com/product/impregnated.html, printed on Dec. 18, 1999, p. 1.

"Integrating Flue Gas Conditioning with More Effective Mercury Control," Power Engineering, Jun. 17, 2014, retrieved from.www.power-eng.com/articles/print/volume-118/issue-6/features/integrating-flue-gas-conditioning-with-more-effective-mercury-control, 9 pages.

"Kaolinite Sorbent for the Removal of Heavy Metals from Incinerated Lubricating Oils," EPA Grant No. R828598C027, 1996, retrieved from https://cfpub.epa.gov/ncer_abstracts/index.cfm/fuseaction/display.highlight/abstract/1166, 7 pages.

"Mercury Emission Control Utilizing the Chem-Mod Process," Chem-Mod, EUEC 2011, 34 pages (submitted in 2 parts).

"Mercury Study Report to Congress—vol. VIII: An Evaluation of Mercury Control Technologies and Costs," U.S. EPA, Office of Air Quality Planning & Standards and Office of Research and Development, Dec. 1997, 207 pages.

"Mercury," Pollution Prevention and Abatement Handbook 1998, World Bank Group, effective Jul. 1998, pp. 219-222.

"Nusorb® Mersorb® Family of Adsorbents for Mercury Control," Nucon International Inc., date unknown, 3 pages.

"Protecting Human Health. Mercury Poisoning," US EPA Website, as early as Oct. 8, 1999, available at http://www.epa.gov/region02/health/mercury/, printed on Feb. 5, 2002, pp. 1-4.

"Sample Collection Media: Sorbent Sample Tubes," SKC 1997 Comprehensive Catalog & Air Sampling Guide: The Essential Reference for Air Sampling, pp. 23-24.

"Sodium Hypochlorite," Wikipedia, The Free Encyclopedia, http://en.wikipedia.org/wiki/Sodium_hypochlorite (page last modified on Jul. 7, 2011 at 18:12), 7 pages.

"Texas Genco, EPRI, and URS Corporation Test Innovative Mercury Control Method at Limestone Station—Technology Aims to Capture More Mercury from Power Plant Exhaust," News Release, Jan. 11, 2005, available at http://amptest.epri.com/corporate/discover_epri/news/2005/011105_mercury.html, printed on Apr. 24, 2009, pp. 1-2.

"The Fire Below: Spontaneous combustion in Coal," U.S. Department of Energy, Environmental Safety & Health Bulletin, DOE/EH-0320, May 1993, Issue No. 93-4, 9 pages.

"Incineration," Focus on your success, Bayer Industry Services, retrieved from www.entsorgung.bayer.com/index.cfmPAGE-ID=301, Jun. 2, 2005, 2 pages.

Anders et al., "Selenium in Coal-Fired Steam Plant Emissions," Environmental Science & Technology, 1975, vol. 9, No. 9, pp. 856-858.

Ariya et al., "Reactions of Gaseous Mercury with Atomic and Molecular Halogens: Kinetics, Product Studies, and Atmospheric Implications," J. Phys. Chem. A, 2002, vol. 106(32), pp. 7310-7320.

Bansal et al., Active Carbon, Marcel Dekker, Inc., New York, 1989, pp. 1-3, 24-29, 391-394, 457.

Beer, J. M., "Combustion technology developments in power generation in response to environmental challenges," Progress in Energy and Combustion Science, 2000, vol. 26, pp. 301-327.

(56) References Cited

OTHER PUBLICATIONS

Biswas et al., "Control of Toxic Metal Emissions from Combustors Using Sorbents: A Review," J. Air & Waste Manage. Assoc., Feb. 1998, vol. 48, pp. 113-127.
Bloom, "Mercury Speciation in Flue Gases: Overcoming the Analytical Difficulties," presented at EPRI Conference, Managing Hazardous Air Pollutants, State of the Arts, Washington D.C., Nov. 1991, pp. 148-160.
Blythe et al., "Investigation of Mercury Control by Wet FGD Systems," Power Plant Air Pollution Mega Symposium, Baltimore, MD, Aug. 20-23, 2012, 16 pages.
Blythe et al., "Optimization of Mercury Control on a New 800-MW PRB-Fired Power Plant," Power Plant Air Pollution Mega Symposium, Baltimore, MD, Aug. 20-23, 2012, 14 pages.
Brigatti et al., "Mercury adsorption by montmorillonite and vermiculite: a combined XRD, TG-MS, and EXAFS study," Applied Clay Science, 2005, vol. 28, pp. 1-8.
Brown et al., "Mercury Measurement and Its Control: What We Know, Have Learned, and Need to Further Investigate," J. Air & Waste Manage. Assoc, Jun. 1999, pp. 1-97.
Buschmann et al., "The KNX™ Coal Additive Technology a Simple Solution for Mercury Emissions Control," Alstom Power Environment, Dec. 2005, pp. 1-7.
Bustard et al., "Full-Scale Evaluation of Sorbent Injection for Mercury Control on Coal-Fired Power Plants," Air Quality III, ADA Environmental Solutions, LLC, Arlington, VA, Sep. 12, 2002, 15 pages.
Butz et al., "Options for Mercury Removal from Coal-Fired Flue Gas Streams: Pilot-Scale Research on Activated Carbon, Alternative and Regenerable Sorbents," 17th Annual Int. Pittsburgh Coal Conf. Proceedings, Pittsburgh, PA, Sep. 11-14, 2000, 25 pages.
Calgon Carbon product and bulletin webpages, printed Jul. 1, 2001, 11 pages.
Cao et al., "Impacts of Halogen Additions on Mercury Oxidation, in a Slipstream Selective Catalyst Reduction (SCR), Reactor When Burning Sub-Bituminous Coal," Environ. Sci. Technol. XXXX, xxx, 000-000, accepted Oct. 22, 2007, pp. A-F.
Carey et al., "Factors Affecting Mercury Control in Utility Flue Gas Using Activated Carbon," J. Air & Waste Manage. Assoc., Dec. 1998, vol. 48, pp. 1166-1174.
De Vito et al., "Sampling and Analysis of Mercury in Combustion Flue Gas," Presented at the Second International Conference on Managing Hazardous Air Pollutants, Washington, DC, Jul. 13-15, 1993, pp. VII39-VII-65.
Dillon et al., "Preparing for New Multi-Pollutant Regulations with Multiple Low Capital Approaches," Paper #2012-A-131-Mega, AWMA, MEGA 2012 conference, retrieved from http://www.cleancoalsolutions.com/library-resources/preparing-for-new-multi-pollutant-regulations-with-multiple-low-capital-approaches/, 20 pages.
Donnet et al., eds., Carbon Black: Science and Technology, 2nd Edition, Marcel Dekker, New York, 1993, pp. 182-187, 218-219.
Dunham et al., "Investigation of Sorbent Injection for Mercury Control in Coal-Fired Boilers," Energy & Environmental Research Center, University of North Dakota, Sep. 10, 1998, 120 pages.
Durham et al., "Full-Scale Evaluation of Mercury Control by Injecting Activated Carbon Upstream of ESPS," Air Quality IV Conference, ADA Environmental Solutions, Littleton, Colorado, Sep. 2003, 15 pages.
Edwards et al., "A Study of Gas-Phase Mercury Speciation Using Detailed Chemical Kinetics," in Journal of the Air and Waste Management Association, vol. 51, Jun. 2001, pp. 869-877.
Element Analysis of COALQUAL Data; http://energy.er.usgs.gov/temp/1301072102.htm, printed Mar. 25, 2011, 7 pages.
Elliott, "Standard Handbook of PowerPlant Engineering," excerpts from pp. 4.77-4.78, 4.109-4.110, 6.3-6.4, 6.57-6.63, McGraw Hill, Inc., 1989, 15 pages.
Fabian et al., "How Bayer incinerates wastes," Hydrocarbon Processing, Apr. 1979, pp. 183-192.
Felsvang et al., "Activated Carbon Injection in Spray Dryer/ESP/FF for Mercury and Toxics Control," 1993, pp. 1-35.
Felsvang, K. et al., "Air Toxics Control by Spray Dryer," Presented at the 1993 SO2 Control Symposium, Aug. 24-27, 1993, Boston, MA, 16 pages.
Felsvang, K. et al., "Control of Air Toxics by Dry FGDSystems," Power-Gen '92 Conference, 5th International Conference & Exhibition for the Power Generating Industries, Orlando, FL, Nov. 17-19, 1992, pp. 189-208.
Fujiwara et al., "Mercury transformation behavior on a bench-scale coal combustion furnace," Transactions on Ecology and the Environment, 2001, vol. 47, pp. 395-404.
Galbreath et al., "Mercury Transformations in Coal Combustion Flue Gas," Fuel Processing Technology, 2000, vol. 65-66, pp. 289-310.
Gale, "Mercury Adsorption and Oxidation Kinetics in Coal-Fired Flue Gas," Proceedings of the 30th International Technical Conference on Coal Utilization & Fuel Systems, 2005, pp. 979-990.
Gale, "Mercury Control with Calcium-Based Sorbents and Oxidizing Agents," Final Report of Southern Research Institute, Jul. 2005, 137 pages.
Gale, "Mercury Control with Calcium-Based Sorbents and Oxidizing Agents," Southern Research Institute, Mercury Control Technology R&D Program Review Meeting, Aug. 12-13, 2003, 25 pages.
Gale et al., "Mercury Speciation as a Function of Flue Gas Chlorine Content and Composition in a 1 MW Semi-Industrial Scale Coal-Fired Facility," In Proceedings of the Mega Symposium and Air & Waste Management Association's Specialty Conference, Washington, DC, May 19-22, 2003, Paper 28, 19 pages.
Geiger et al, "Einfluß des Schwefels auf Die Doxin—und Furanbuilding bei der Klärschlammverbrennung," VGB Kraftwerkstechnik, 1992, vol. 72, pp. 159-165.
Ghorishi et al., "Effects of Fly Ash Transition Metal Content and Flue Gas HCI/SO2 Ratio on Mercury Speciation in Waste Combustion," in Environmental Engineering Science, Nov. 2005, vol. 22, No. 2, pp. 221-231.
Ghorishi et al., "In-Flight Capture of Elemental Mercury by a Chlorine-Impregnated Activated Carbon," presented at the Air & Waste Management Association's 94h Annual Meeting & Exhibition, Orlando, FL, Jun. 2001, pp. 1-14.
Ghorishi, "Fundamentals of Mercury Speciation and Control in Coal-Fired Boilers," EAP Research and Development, EPA-600/R-98-014, Feb. 1998, pp. 1-26.
Granite et al., "Novel Sorbents for Mercury Removal from Flue Gas," National Energy Technology Laboratory, Apr. 2000, 10 pages.
Granite et al., "Sorbents for Mercury Removal from Flue Gas," U.S. Dept. of Energy, Report DOE/FETC/TR-98-01, Jan. 1998, 50 pages.
Granite et al. "The thief process for mercury removal from flue gas," Journal of environmental management 84.4 (2007):628-634.
Griffin, "A New Theory of Dioxin Formation in Municipal Solid Waste Combustion," Chemosphere, 1986, vol. 15, Nos. 9-12, pp. 1987-1990.
Griswell et al., "Progress Report on Mercury Control Retrofit at the Colstrip Power Station," Power Plant Air Pollutant Control "MEGA" Symposium, Paper #91, Aug. 30-Sep. 2, 2010, pp. 1-23.
Gullet, B.K. et al, "The Effect of Sorbent Injection Technologies on Emissions of Coal-Based, Based, Metallic Air Toxics," Proceedings of the 1993 S02 Control Symposium, vol. 2, U.S. EPA (Research Triangle Park, NC) Session 6A, Boston, MA, Aug. 24-27, 1993, 26 pages.
Gullett, B. et al., "Bench-Scale Sorption and Desorption of Mercury with Activated Carbon," Presented at the 1993 International Conference on Municipal Waste Combustion, Williamsburg, VA, Mar. 30-Apr. 2, 1993, pp. 903-917.
Gullett, B. et al., "Removal of Illinois Coal-Based Volatile Tracy Mercury," Final Technical Report, Sep. 1, 1996 through Aug. 31,1997, 2 pages.
Guminski, "The Br-Hg (Bromine-Mercury) System," Journal of Phase Equilibria, Dec. 2000, vol. 21, No. 6, pp. 539-543.
Gutberlet et al., "The Influence of Induced Oxidation on the Operation of Wet FGD Systems," Air Quality V Conference, Arlington, VA, Sep. 19-21, 2005, 15 pages.

(56) References Cited

OTHER PUBLICATIONS

Hall et al., "Chemical Reactions of Mercury in Combustion Flue Gases," Water, Air, and Soil Pollution, 1991, vol. 56, pp. 3-14.
Hein, K.R.G. et al., Research Report entitled, "Behavior of Mercury Emission from Coal Sewage Sludge Co-combustion Taking into Account the Gaseous Species," Förderkennzeichen: PEF 398002, Apr. 2001 (English Abstract).
Henning et al., "Impregnated activated carbon for environmental protection," Gas Separation & Purification, Butterworth-Heinemann Ltd., Feb. 1993, vol. 7(4), pp. 235-240.
Ismo et al., "Formation of Aromatic Chlorinated Compounds Catalyzed by Copper and Iron," Chemosphere, 1997, vol. 34(12), pp. 2649-2662.
Jeong et al. "Nox Removal by Selective Noncatalytic Reduction with Urea Solution in a Fluidized Bed Reactor," Korean Journal of Chemical Engineering, Sep. 1999, vol. 16, No. 5, pp. 614-617.
Jozewicz et al., "Bench-Scale Scale Investigation of Mechanisms of Elemental Mercury Capture by Activated Carbon," Presented at the Second International Conference on Managing Hazardous Air Pollutants, Washington, D.C., Jul. 13-15, 1993, pp. VII-85 through VII-99.
Julien et al., "The Effect of Halides on Emissions from Circulating Fluidized Bed Combustion of Fossil Fuels," Fuel, Nov. 1996, vol. 75(14), pp. 1655-1663.
Kaneko et al., "Pitting of stainless steel in bromide, chloride and bromide/chloride solutions," Corrosion Science, 2000, vol. 42(1), pp. 67-78.
Kellie et al., "The Role of Coal Properties on Chemical and Physical Transformation on Mercury in Post Combustion," presented at Air Quality IV Conference, Arlington, VA, Sep. 2003, pp. 1-14.
Kilgroe et al. "Fundamental Science and Engineering of Mercury Control in Coal-Fired Power Plants," presented at Air Quality IV Conference, Arlington, VA, Sep. 2003, 15 pages.
Kilgroe et al., "Control of Mercury Emissions from Coal-Fired Electric Utility Boilers: Interim Report including Errata dated Mar. 21, 2002," prepared by National Risk Management Research Laboratory, U.S. EPA Report EPA-600/R-01-109, Apr. 2002, 485 pages.
Kobayashi, "Japan EnviroChemicals, Ltd. Overview," Feb. 3, 2002, 3 pages.
Kramlich, "The Homogeneous Forcing of Mercury Oxidation to Provide Low-Cost Capture," Abstract, University of Washington, Department of Mechanical Engineering, Mar. 25, 2004, available at http://www.netl.doe.gov/publications/proceedings/04/UCR-HBCU/abstracts/Kramlich.pdf, pp. 1-2.
Krishnan et al., "Mercury Control by Injection of Activated Carbon and Calcium-Based Based Sorbents," Solid Waste Management: Thermal Treatment and Waste-to-Energy Technologies, U.S. EPA and AWMA, Washington, DC, Apr. 18-21, 1995, pp. 493-504.
Krishnan et al., "Mercury Control in Municipal Waste Combustors and Coal Fired Utilities," Environmental Progress, ProQuest Science Journals, Spring 1997, vol. 16, No. 1, pp. 47-53.
Krishnan et al., "Sorption of Elemental Mercury by Activated Carbons," Environmental Science and Technology, 1994, vol. 28, No. 8, pp. 1506-1512.
Lee et al., "Mercury Control Research: Effects of Fly Ash and Flue Gas Parameters on Mercury Speciation," U.S. Environmental Protection Agency National Risk Management Research Laboratory and ARCADIS, as early as 1998, Geraghy & Miller, Inc., pp. 221-238, Research Triangle Park, NC.
Lee et al., "Pilot-Scale Study of the Effect of Selective Catalytic Reduction Catalyst on Mercury Speciation in Illinois and Powder River Basin Coal Combustion Flue Gases," J. Air & Waste Manage. Assoc., May 2006, vol. 56, pp. 643-649.
Lemieux et al., "Interactions Between Bromine and Chlorine in a Pilot-Scale Hazardous Waste Incinerator," paper presented at 1996 International Incineration Conference, Savannah, GA, May 6-10, 1996, 14 pages.
Li et al., "Effect of Moisture on Adsorption of Elemental Mercury by Activated Carbons," Report No. EPA/600/A-00/104, U.S. EPA, Office of Research and Development Nation Risk Management, Research Laboratory (10-65), 2000, pp. 1-Li to 13-Li.
Li et al., "Mercury Emissions Control in Coal Combustion Systems Using Postassium Iodide: Bench-Scale and Pilot-Scale Studies," Energy & Fuels, Jan. 5, 2009, vol. 23, pp. 236-243.
Linak et al., "Toxic Metal Emissions from Incineration: Mechanisms and Control," Progress in Energy & Combustion Science, 1993, vol. 19, pp. 145-185.
Lissianski et al., "Effect of Coal Blending on Mercury Removal," presented at the Low Rank Fuels Conference, Billings, MT, Jun. 24-26, 2003, pp. 1-9.
Livengood et al., "Development of Mercury Control Techniques for Utility Boilers," for Presentation at the 88th Air & Waste Management Association Annual Meeting & Exhibit, Jun. 18-23, 1995, pp. 1-14.
Livengood et al., "Enhanced Control of Mercury Emissions Through Modified Speciation," for Presentation at the Air & Waste Management Association's 90th Meeting & Exhibition, Jun. 8-13, 1997, 14 pages.
Livengood et al., "Investigation of Modified Speciation for Enhanced Control of Mercury," Argonne National Laboratory, 1998, available at http://www.netl.doe.gov/publications/proceedings/97/97ps/ps_pdf/PS2B-9.pdf, pp. 1-15.
Luijk et al., "The Role of Bromine in the De Novo Synthesis in a Model Fly Ash System," Chemosphere, 1994, vol. 28, No. 7, pp. 1299-1309.
Martel, K., "Brennstoff-und lastspezifische Untersuchungen zum Verhalten von Schwermetallen in Kohlenstaubfeuerungen [Fuel and load specific studies on the behavior of heavy metals in coal firing systems]," Fortschritt-Berichte VDI, Apr. 2000, pp. 1-240.
McCoy et al., "Full-Scale Mercury Sorbent Injection Testing at DTE Energy's St. Clair Station," Paper #97, DTE Energy, as early as 2004, pp. 1-9.
McCoy, "Urea's Unlikely Role: Emissions Reduction is new application for chemical best known as a fertilizer," Chemical and Engineering News, Jun. 6, 2011, vol. 89, No. 23, p. 32.
Meij et al., "The Fate and Behavior of Mercury in Coal-Fired Power Plants," J. Air & Waste Manage. Assoc., Aug. 2002, vol. 52, pp. 912-917.
Niksa et al., "Predicting Mercury Speciation in Coal-Derived Flue Gases," presented at the 2003 Combined Power Plant Air Pollutant Control Mega Symposium, Washington, D.C., May 2003, pp. 1-14.
Oberacker et al., "Incinerating the Pesticide Ethylene Dibromide (EDB)—A field-Scale Trail Burn Evaluation of Environmental Performance," Report EPA /600/D-88/198, Oct. 1988, pp. 1-11.
Olson et al., "An Improved Model for Flue Gas-Mercury Interactions on Activated Carbons," presented at Mega Symposium May 21, 2003, Energy & Environmental Research Center publication, Paper # 142, pp. 1-8.
Olson et al., "Oxidation Kinetics and the Model for Mercury Capture on Carbon in Flue Gas," presented at Air Quality V Conference, Sep. 21, 2005, pp. 1-7.
Oppenheimer et al., "Thermische Entsorgung von Produktionsabfällen," Entsorgungs-Praxis, 2000, vol. 6, pp. 29-33.
Pasic et al., "Membrane Electrostatic Precipitation, Center for Advanced Materials Processing," Ohio Coal Research Center Department of Mechanical Engineering, Ohio University, on or before 2001, pp. 1-Bayless to 10-Bayless.
Paulik et al., "Examination of the Decomposition of CaBr2 with the Method of Simultaneous TG, DTG, DTA and EGA," Journal of Thermal Analysis, vol. 15, 1979, 4 pages.
Pavlish et al., "Status Review of Mercury Control Options for Coal-Fired Power Plants," Fuel Processing Technology, Aug. 2003, vol. 82, pp. 89-165.
Richardson et al,, "Chemical Addition for Mercury Control in Flue Gas Derived from Western Coals," presented at the 2003 Combined Power Plant Air Pollutant Control Mega Symposium, Washington D.C., May 2003, Paper # 63, pp. 1-16.
Rodriguez et al., "Iodine Room Temperature Sorbents for Mercury Capture in Combustion Exhausts," 2001, 14 pages.

(56) References Cited

OTHER PUBLICATIONS

Samaras et al., "PCDD/F Prevention by Novel Inhibitors: Addition of Inorganic S- and N-Compounds in the Fuel before Combustion," Environmental Science and Technology, 2000, vol. 34, No. 24, pp. 5092-5096.
Sarkar et al., "Adsorption of Mercury(II) by Kaolinite," Soil Science Society of America Journal, 1999, vol. 64(6), pp. 1968-1975, abstract only, 1 page.
Schmidt et al., "Innovative Feedback Control System for Chemical Dosing to Control Treatment Plant Odors," Proceedings of the Water Environment Federation, WEFTEC 2000: Session 11-Session 20, pp. 166-175 (Abstract), 2 pages.
Schüetze et al., "Redox potential and co-removal of mercury in wet FGD scrubbers," Air Quality VIII Conference, Crystal City, VA, Oct. 24-27, 2011, 1 page.
Schüetze et al., "Strategies for enhanced co-removal of mercury in wet FGD-scrubbers—process control and additives," Flue Gas Cleaning, Helsinki, Finland, May 26, 2011, 25 pages.
Senior et al., "Gas-Phase Transformations of Mercury in Coal-Fired Power Plants," Fuel Processing Technology, vol. 63, 2000, pp. 197-213.
Senior, "Behavior of Mercury in Air Pollution Control Devices on Coal-Fired Utility Boilers," Power Production in the 21st Century: Impacts of Fuel Quality and Operations, Engineering Foundation Conference, Snowbird, UT, Oct. 28-Nov. 2, 2001, 17 pages.
Serre et al., "Evaluation of the Impact of Chlorine on Mercury Oxidation in a Pilot-Scale Coal Combustor—the Effect of Coal Blending," U.S. Environmental Protection Agency, Sep. 2009, 21 pages.
Sjostrom et al., "Full-Scale Evaluation of Mercury Control at Great River Energy's Stanton Generating Station Using Injected Sorbents and a Spray Dryer/Baghouse," to be presented at Air Quality III Conference, Session A3b, 2002, 14 pages.
Sjostrom et al., "Full-Scale Evaluation of Mercury Control by Injecting Activated Carbon Upstream of a Spray Dryer and Fabric Filter," Presented at the 2004 combined power plant air pollutant control mega symposium, Washington, D.C., Aug. 2004, 18 pages.
Sjostrom et al., "Long-Term Carbon Injection Field Test for > 90% Mercury Removal for a PRB Unit with a Spray Dryer and Fabric Filter," ADA-ES, Inc. Final Scientific/Technical Report, Apr. 2009, 82 pages.
Sjostrom, "Evaluation of Sorbent Injection for Mercury Control," ADA-ES, Inc. Topical Report for Basin Electric Power Cooperative's Laramie River Station, Jan. 16, 2006, 49 pages.
Sjostrom, "Evaluation of Sorbent Injection for Mercury Control," Topical Report for Sunflower Electric's Holcomb Station, U.S. DOE Cooperative Agreement No. DE-FC26-03NT41986, Topical Report No. 41986R07, Jun. 28, 2005, 85 pages.
Sliger et al., "Towards the Development of a Chemical Kinetic Model for the Homogeneous Oxidation of Mercury by Chlorine Species," Fuel Processing Technology, vol. 65-66, 2000, pp. 423-438.
Speight, ed., The Chemistry and Technology of Coal, CRC Press, 1994, pp. 152-155.
Starns et al., "Full-Scale Evaluation of TOXECON II™ on a Lignite-Fired Boiler" presented at US EPA/DOE/EPRI Combiner Power Plant Air Pollutant Control Symposium: The Mega Symposium, Washington, DC, Aug. 30-Sep. 2, 2004, 14 pages.
Staudt et al., "Control Technologies to Reduce Conventional and Hazardous Air Pollutants from Coal-Fired Power Plants," prepared for Northeast States for Coordinated Air Use Management (NESCAUM), Mar. 31, 2011, retrieved from www.nescaum.org/ . . ./coal-control-technology-nescaum-report-20110330.pdf, 36 pages.
Sudhoff, "Anticipated Benefits of the TOXECON Retrofit for Mercury and Multi-Pollutant Control Technology," National Energy Technology Laboratory, Nov. 19, 2003, available at http://www.netl.doe.gov/technologies/coalpower/cctc/pubs/Benefits_TOXECON_111903.pdf, pp. 1-20.
Teller et al., "Mercury Removal from Incineration Flue Gas," Air and Water Technologies Co., for presentation at the 84th Annual Meeting & Exhibition Vancouver, British Columbia, Jun. 16-21, 1991, 10 pages.
United States Environmental Protection Agency, "Study of Hazardous Air Pollutant Emissions from Electric Utility Steam Generating Units," Report to Congress, vol. 1-2, EPA-453/R-98-004a&b, Feb. 1998, pp. 1-165.
Urabe et al., "Experimental Studies on Hg Vapor Removal Using Corona Discharge for Refuse Incinerator," Chemical Abstracts, Oct. 1997, vol. 109, 37 pages (includes translation).
Urano, S., "Studies on Bleaching Powder, VII. The Decomposition of Calcium Hypochlorite by Heat in the Presence of Calcium Chloride," Journal of the Society of Chemical Industry of Japan, vol. 31, 1928, pp. 46-52 (no translation).
Verhulst et al., "Thermodynamic Behavior of Metal Chlorides and Sulfates under the Conditions of Incineration Furnaces," Environmental Science & Technology, 1996, vol. 30, No. 1, pp. 50-56.
Vidic et al., "Uptake of Elemental Mercury Vapors by Activated Carbons," Journal of the Air & Waste Management Association, 1996, vol. 46, pp. 241-250.
Vidic et al., "Vapor-phase elemental mercury adsorption by activated carbon impregnated with chloride and cheltinq agents," Carbon, 2001, vol. 39, pp. 3-14.
Vosteen et al., Mercury Sorption and Mercury Oxidation by Chlorine and Bromine at SCR DeNOx Catalyst (Part A: Oxidation), 9th Annual EPA, DOE, EPRI, EEI Conference on Clean Air, Mercy Global Warming & Renewable Energy, Tucson, AZ, Jan. 24, 2005, 38 pages.
Vosteen et al, "Mercury-Related Chemistry in Waste Incineration and Power Generation Flue Gases," Sep. 2003, Air Quality IV, pp. 1-8.
Vosteen et al., "Bromine Enhanced Mercury Abatement from Combustion Flue Gases—Recent Industrial Applications and Laboratory Research," VGB PowerTech, International Journal for Electricity and Heat Generation, 2006, vol. 86, No. 3, pp. 70-75.
Vosteen et al., "Bromine Enhanced Mercury Abatement from Combustion Flue Gases—Recent Industrial Applications and Laboratory Research," VGB PowerTech, 2nd International Experts' Workshop on Mercury Emissions from Coal (MEC2), May 24 & 25, 2005, 8 pages.
Weber et al., "The Role of Copper(II) Chloride in the Formation of Organic Chlorine in Fly Ash," Chemosphere, 2001, vol. 42, pp. 479-582.
White et al., "Field Test of Carbon Injection for Mercury Control at Camden County Municipal Waste Combustor," EPA-600/R-93-181 (NTIS PB94-101540), Sep. 1993, pp. 1-11.
Withum et al., "Characterization of Coal Combustion By-Products for the Re-Evolution of Mercury into Ecosystems," Consol Energy Inc., Research and Development, Mar. 2005, 48 pages.
Working project report for period Oct. 1, 1999 to Sep. 30, 2001 from Institut fur Verhrenstechnik und Dampfkesselwessen (IVD), Universitat Stuttgart, dated Mar. 28, 2002, pp. 14-38.
Zevenhoven et al., "Control of Pollutants in flue gases and fuel gases," Trace Elements, Alkali Metals, 2001, 32 pages.
Zygarlicke et al., "Flue gas interactions of mercury, chlorine, and ash during coal combustion," Proceedings of the 23rd International Technical Conference on Coal Utilization and Fuel Systems, Clearwater, Florida, Mar. 9-13, 1998, pp. 517-526 (ISBN 0-03206602302).
Notice of Allowance for U.S. Appl. No. 15/850,780, dated May 9, 2019 7 pages.
Official Action for U.S. Appl. No. 13/471,015, dated Nov. 13, 2013, 7 pages, Restriction Requirement.
Official Action for U.S. Appl. No. 13/471,015, dated Jan. 21, 2014, 5 pages, Restriction Requirement.
Notice of Allowance for U.S. Appl. No. 13/471,015, dated May 23, 2014 10 pages.
Official Action for U.S. Appl. No. 14/484,001, dated May 19, 2015 7 pages.
Notice of Allowance for U.S. Appl. No. 14/484,001, dated Sep. 3, 2015 6 pages.
Official Action for U.S. Appl. No. 14/958,327, dated Feb. 3, 2017, 14 pages.

(56) References Cited

OTHER PUBLICATIONS

Notice of Allowance for U.S. Appl. No. 14/958,327, dated Aug. 10, 2017, 7 pages.
Protest for Canadian Patent Application No. 2788820, dated Feb. 26, 2018, 6 pages.
Protest for Canadian Application No. 2788820, dated Nov. 6, 2018, 10 pages.
Notice of Protest for Canadian Application No. 2793326, dated Feb. 3, 2017, 16 pages.
Notice of Protest for Canadian Application No. 2793326, dated Jul. 7, 2017, 6 pages.
Notice of Protest for Canadian Application No. 2793326, dated Apr. 19, 2018, 17 pages.
Notice of Protest for Canadian Application No. 2793326, dated Feb. 14, 2019, 12 pages.
Official Action for U.S. Appl. No. 16/503,239, dated Jan. 13, 2020 9 pages.
Notice of Allowance for U.S. Appl. No. 16/188,758, dated Dec. 31, 2019, 5 pages.
Final Action for U.S. Appl. No. 15/941,522, dated Jan. 9, 2020 14 pages.
Official Action for U.S. Appl. No. 15/812,993, dated Oct. 12, 2018, 13 pages.
Official Action for U.S. Appl. No. 15/812,993, dated Mar. 4, 2019, 10 pages.
Notice of Allowance for U.S. Appl. No. 15/812,993, dated Jun. 24, 2019, 8 pages.
U.S. Appl. No. 16/834,685, filed Mar. 30, 2020, Sjostrom et al.
Haiwen, "Basic Science Series of Database of Excellent Master's Degree Theses in China," No. 7, Geochemistry of Iodine in Chinese Coal, Jul. 2008, pp. 29-32, English translation, 8 pages.
Matai et al., "Iodine Deficiency Disease-Local Goiter and Local Cretinism," 2nd Edition, People's Medical Publishing House, Jun. 1993, pp. 47-49, English translation, 9 pages.
Metals Handbook, 9th Edition, Corrosion, vol. 13, ASM International, 1987, pp. 997-998, 6 pages.
Mills Jr., "Techline: Meeting Mercury Standards," as early as Jun. 18, 2001, available at http://www.netl.doe/publications/press/2001/tl_mercuryel2.html, printed on Feb. 5, 2002, pp. 1-3.
Moberg et al., "Migration of Trace Elements During Flue Gas Desulfurization," Report No. KHM-TR-28, Jun. 1982 (abstract only).

* cited by examiner

PROCESS TO REDUCE EMISSIONS OF NITROGEN OXIDES AND MERCURY FROM COAL-FIRED BOILERS

CROSS REFERENCE TO RELATED APPLICATION

The present application is a continuation of U.S. application Ser. No. 15/812,993, filed on Nov. 14, 2017, which is a continuation of U.S. application Ser. No. 14/958,327, filed on Dec. 3, 2015, which issued as U.S. Pat. No. 9,850,442, which is a continuation of U.S. application Ser. No. 14/484,001, filed on Sep. 11, 2014, which issued as U.S. Pat. No. 9,238,782 on Jan. 19, 2016, which is a divisional of U.S. application Ser. No. 13/471,015, filed on May 14, 2012, which issued as U.S. Pat. No. 8,845,986 on Sep. 30, 2014, which claims the benefits of U.S. Provisional Application Ser. No. 61/543,196, filed Oct. 4, 2011, and Ser. No. 61/486,217, filed May 13, 2011, all of which are entitled "Process to Reduce Emissions of Nitrogen Oxides and Mercury From Coal-Fired Boilers;" each of which is incorporated herein by this reference in its entirety.

FIELD

The disclosure relates generally to removal of contaminants from gases and particularly to removal of mercury and nitrogen oxides from flue gases.

BACKGROUND

A major source of environmental pollution is the production of energy. While research into alternative, cleaner sources of energy has grown, the vast majority of the energy produced in the world is still obtained from fossil fuels such as coal, natural gas and oil. In fact, in 2005, 75% of the world's energy was obtained from fossil fuels (Environmental Literacy Council). Of these fossil fuels, coal provides 27% of the world's energy and 41% of the world's electricity. Thus, there is also increased interest in making current energy producing processes more environmentally friendly (i.e., cleaner).

Coal is an abundant source of energy. Coal reserves exist in almost every country in the world. Of these reserves, about 70 countries are considered to have recoverable reserves (World Coal Association). While coal is abundant, the burning of coal results in significant pollutants being released into the air. In fact, the burning of coal is a leading cause of smog, acid rain, global warning, and toxins in the air (Union of Concerned Scientists). In an average year, a single, typical coal plant generates 3.7 million tons of carbon dioxide ($CO_2$), 10,000 tons of sulfur dioxide ($SO_2$), 10,200 tons of nitric oxide ($NO_x$), 720 tons of carbon monoxide (CO), 220 tons of volatile organic compounds, 225 pounds of arsenic and many other toxic metals, including mercury.

Emissions of $NO_x$ include nitric oxide (NO) and nitrogen dioxide ($NO_2$). Free radicals of nitrogen ($N_2$) and oxygen ($O_2$) combine chemically primarily to form NO at high combustion temperatures. This thermal $NO_x$ tends to form even when nitrogen is removed from the fuel. Combustion modifications, which decrease the formation of thermal $NO_x$, generally are limited by the generation of objectionable byproducts.

Mobile and stationary combustion equipment are concentrated sources of $NO_x$ emissions. When discharged to the air, emissions of NO oxidize to form $NO_2$, which tends to accumulate excessively in many urban atmospheres. In sunlight, the $NO_2$ reacts with volatile organic compounds to form ground level ozone, eye irritants and photochemical smog. These adverse effects have prompted extensive efforts for controlling $NO_x$ emissions to low levels. Despite advancements in fuel and combustion technology, ground level ozone concentrations still exceed federal guidelines in many urban regions. Under the Clean Air Act and its amendments, these ozone nonattainment areas must implement stringent $NO_x$ emissions regulations. Such regulations will require low $NO_x$ emissions levels that are attained only by exhaust after treatment.

Exhaust-after-treatment techniques tend to reduce $NO_x$ using various chemical or catalytic methods. Such methods are known in the art and involve selective catalytic reduction (SCR) or selective noncatalytic reduction (SNCR). Such after-treatment methods typically require some type of reactant such as ammonia or other nitrogenous agent for removal of $NO_x$ emissions.

SCR is performed typically between the boiler and air (pre) heater and, though effective in removing nitrogen oxides, represents a major retrofit for coal-fired power plants. SCR commonly requires a large catalytic surface and capital expenditure for ductwork, catalyst housing, and controls. Expensive catalysts must be periodically replaced, adding to ongoing operational costs.

Combustion exhaust containing excess $O_2$ generally requires chemical reductant(s) for $NO_x$ removal. Commercial SCR systems primarily use ammonia ($NH_3$) or urea ($CH_4N_2O$) as the reductant. Chemical reactions on a solid catalyst surface convert $NO_x$ to $N_2$. These solid catalysts are selective for $NO_x$ removal and do not reduce emissions of CO and unburned hydrocarbons. Excess $NH_3$ needed to achieve low NO levels tends to result in $NH_3$ breakthrough as a byproduct emission.

Large catalyst volumes are normally needed to maintain low levels of $NO_x$ and $_x$inhibit $NH_3$ breakthrough. The catalyst activity depends on temperature and declines with use. Normal variations in catalyst activity are accommodated only by enlarging the volume of catalyst or limiting the range of combustion operation. Catalysts may require replacement prematurely due to sintering or poisoning when exposed to high levels of temperature or exhaust contaminants. Even under normal operating conditions, the SCR method requires a uniform distribution of $NH_3$ relative to $NO_x$ in the exhaust gas. $NO_x$ emissions, however, are frequently distributed non-uniformly, so low levels of both $NO_x$ and $NH_3$ breakthrough may be achieved only by controlling the distribution of injected $NH_3$ or mixing the exhaust to a uniform $NO_x$ level.

SCR catalysts can have other catalytic effects that can undesirably alter flue gas chemistry for mercury capture. Sulfur dioxide ($SO_2$ can be catalytically oxidized to sulfur trioxide, $SO_3$, which is undesirable because it can cause problems with the operation of the boiler or the operation of air pollution control technologies, including the following: interferes with mercury capture on fly ash or with activated carbon sorbents downstream of the SCR; reacts with excess ammonia in the air preheater to form solid deposits that interfere with flue gas flow; forms an ultrafine sulfuric acid aerosol, which is emitted out the stack.

Although SCR is capable of meeting regulatory $NO_x$ reduction limits, additional $NO_x$ removal prior to the SCR is desirable to reduce the amount of reagent ammonia introduced within the SCR, extend catalyst life and potentially reduce the catalyst surface area and activity required to achieve the final $NO_x$ control level. For systems without SCR installed, a $NO_x$ trim technology, such as SNCR, combined with retrofit combustion controls, such as low $NO_x$ burners and staged combustion, can be combined to achieve regulatory compliance.

SNCR is a retrofit $NO_x$ control technology in which ammonia or urea is injected post-combustion in a narrow temperature range of the flue path. SNCR can optimally remove up to 20 to 40% of $NO_x$. It is normally applied as a $NO_x$ trim method, often in combination with other $NO_x$ control methods. It can be difficult to optimize for all combustion conditions and plant load. The success of SNCR for any plant is highly dependent on the degree of mixing and distribution that is possible in a limited temperature zone. Additionally, there can be maintenance problems with SNCR systems due to injection lance pluggage and failure.

Other techniques have been employed to control $NO_x$ emissions. Boiler design and burner configuration, for example, can have a major influence on $NO_x$ emission levels. Physically larger furnaces (for a given energy input) can have low furnace heat release rates which lead to decreased levels of $NO_x$. The use of air-staged burners and over-fire air, both of which discourage the oxidation of nitrogen by the existence of sub-stoichiometric conditions in the primary combustion zone, can also lead to lower levels of $NO_x$. Over-fire air employs the same strategy as air-staging in which the oxidation of nitrogen is discouraged by the existence of sub-stoichiometric conditions in the primary combustion zone.

Another major contaminant of coal combustion is mercury. Mercury enters the furnace associated with the coal, it is volatilized upon combustion. Once volatilized, mercury tends not to stay with the ash, but rather becomes a component of the flue gases. If remediation is not undertaken, the mercury tends to escape from the coal burning facility, leading to severe environmental problems. Some mercury today is captured by pollution control machinery, for example in wet scrubbers and particulate control devices such as electrostatic precipitators and baghouses. However, most mercury is not captured and is therefore released through the exhaust stack.

In addition to wet scrubbers and particulate control devices that tend to remove mercury partially from the flue gases of coal combustion, other methods of control have included the use of activated carbon systems. Use of such systems tends to be associated with high treatment costs and elevated capital costs. Further, the use of activated carbon systems leads to carbon contamination of the fly ash collected in exhaust air treatments such as the bag house and electrostatic precipitators.

There is a need for an additive and treatment process to reduce emissions of target contaminants, such as nitrogen oxides and mercury.

SUMMARY

These and other needs are addressed by the various aspects, embodiments, and configurations of the present disclosure. The present disclosure is directed generally to the removal of selected gas phase contaminants.

In a first embodiment, a method is provided that includes the steps:

(a) contacting a combustion feed material with an additive to form a combined combustion feed material, the additive comprising a nitrogenous material; and (b) combusting the combined combustion feed material to form an off-gas comprising a nitrogen oxide and a derivative of the nitrogenous material, the derivative of the nitrogenous material causing removal of the nitrogen oxide.

In another embodiment, a flue gas additive is provided that includes:

(a) a nitrogenous material that forms ammonia when combusted; and (b) a halogen-containing material that forms a gas phase halogen when combusted.

In another embodiment, a method is provided that includes the steps:

(a) combusting a combustion feed material in a combustion zone of a combustor, thereby generating a nitrogen oxide; and (b) introducing a nitrogenous material into the combustion zone to reduce the nitrogen oxide.

The combustion zone has a temperature commonly ranging from about 1,400° F. to about 3,500° F., more commonly from about 1,450° F. to about 2,000° F., and even more commonly from about 1,550° F. to about 1,800° F.

In yet another embodiment, a combined combustion feed material is provided that includes a nitrogenous material for reducing nitrogen oxides and coal.

The nitrogenous material is commonly one or both of an amine and amide, which thermally decomposes into ammonia. More commonly, the nitrogenous material is urea. While not wishing to be bound by any theory, the mechanism is believed to primarily be urea decomposition to ammonia followed by free radical conversion of $NH_3$ to $NH_2$* and then reduction of NO.

The additive can have a number of forms. In one formulation, the additive is a free flowing particulate composition having a $P_{80}$ size ranging from about 6 to about 20 mesh (Tyler). In another formulation, the primary particle size is controlled by an on-line milling method having a $P_{80}$ outlet size typically less than 60 mesh (Tyler). In another formulation, the nitrogenous material is supported by a particulate substrate, the particulate substrate being one or more of the combustion feed material, a zeolite, other porous metal silicate material, clay, activated carbon, char, graphite, (fly) ash, metal, and metal oxide. In yet another formulation, the nitrogenous material comprises a polymerized methylene urea.

When the combustion feed material includes mercury, which is volatilized by combustion of the combined combustion feed material, the additive can include a halogen-containing material to oxidize the elemental mercury.

In one application, an amount of nitrogenous material is added to the off-gas at a normalized stoichiometric ratio (NSR) of ammonia to nitrogen oxides of about 1 to 3. Commonly, the combined combustion feed material includes from about 0.05 to about 1 wt. % and even more commonly from about 0.05 to about 0.75 wt. % nitrogenous additive, and commonly a mass ratio of the nitrogen content of the nitrogenous material:halogen in the additive ranges from about 1:1 to about 2400:1.

When the nitrogenous material is added to the combustion feed material, loss of some of the nitrogenous material during combustion can occur. Commonly, at least a portion of the nitrogenous material in the combined combustion feed material is lost as a result of feed material combustion.

In an application, the additive is combined with the combustion feed material remote from the combustor and transported to the combustor.

In another application, process control is effected by the following steps/operations:

(a) monitoring at least one of the following parameters: rate of introduction of the additive to the combustor, concentration of gas phase molecular oxygen, combustor temperature, gas phase carbon monoxide, gas phase nitrogen dioxide concentration, gas phase nitric oxide concentration, gas phase $NO_x$, limestone concentration, and gas phase $SO_2$ concentration; and (b) when a selected change in the at least one of the parameters occurs, changing at least one of the parameters.

In one application, a mass ratio of the nitrogen:halogen in the additive ranges from about 1:1 to about 2400:1.

The additive closely resembles SNCR in that it can use the same reagents to reduce nitrogen oxides but it does not depend on a specific post-combustion injection location and does not utilize an injection grid. Distribution of the additive is not as critical as for SNCR because the reagent is added with the fuel and is pre-mixed during combustion.

The present disclosure can provide a number of advantages depending on the particular configuration. The present disclosure can allow comparable $NO_x$ reduction to SNCR while eliminating problems of reagent distribution, injection lance fouling and maintenance. It can also have a wider tolerance for process temperature variation than post-combustion SNCR since the nitrogenous reagent is introduced pre-combustion. The disclosure discloses processes for the application of typical nitrogen oxide reduction reagents but generally relies on boiler conditions to facilitate distribution and encourage appropriate reaction kinetics. Furthermore, the current process can use existing coal feed equipment as the motive equipment for introduction of the reagents to the boiler. Only minor process-specific equipment may be required. Use of the disclosed methods will decrease the amount of pollutants produced from a fuel, while increasing the value of such fuel. Because the additive can facilitate the removal of multiple contaminants, the additive can be highly versatile and cost effective. Finally, because the additive can use nitrogenous compositions which are readily available in certain areas, for example, the use of animal waste and the like, without the need of additional processing, the cost for the compositions may be low and easily be absorbed by the user.

These and other advantages will be apparent from the disclosure of the aspects, embodiments, and configurations contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

"Absorption" is the incorporation of a substance in one state into another of a different state (e.g. liquids being absorbed by a solid or gases being absorbed by a liquid). Absorption is a physical or chemical phenomenon or a process in which atoms, molecules, or ions enter some bulk phase—gas, liquid or solid material. This is a different process from adsorption, since molecules undergoing absorption are taken up by the volume, not by the surface (as in the case for adsorption).

"Adsorption" is the adhesion of atoms, ions, biomolecules, or molecules of gas, liquid, or dissolved solids to a surface. This process creates a film of the adsorbate (the molecules or atoms being accumulated) on the surface of the adsorbent. It differs from absorption, in which a fluid permeates or is dissolved by a liquid or solid. Similar to surface tension, adsorption is generally a consequence of surface energy. The exact nature of the bonding depends on the details of the species involved, but the adsorption process is generally classified as physisorption (characteristic of weak van der Waals forces) or chemisorption (characteristic of covalent bonding). It may also occur due to electrostatic attraction.

"Amide" refers to compounds with the functional group $R_nE(O)_xNR'_2$ (R and R' refer to H or organic groups). Most common are "organic amides" (n=1, E=C, x=1), but many other important types of amides are known including phosphor amides (n=2, E=P, x=1 and many related formulas) and sulfonamides (E=S, x=2). The term amide can refer both to classes of compounds and to the functional group ($R_nE(O)_x NR'_2$) within those compounds.

"Amines" are organic compounds and functional groups that contain a basic nitrogen atom with a lone pair. Amines are derivatives of ammonia, wherein one or more hydrogen atoms have been replaced by a substituent such as an alkyl or aryl group.

"Ash" refers to the residue remaining after complete combustion of the coal particles. Ash typically includes mineral matter (silica, alumina, iron oxide, etc.).

Circulating Fluidized Bed ("CFB") refers to a combustion system for solid fuel (including coal or biomass). In fluidized bed combustion, solid fuels are suspended in a dense bed using upward-blowing jets of air. Combustion takes place in the bed of suspended fuel particles. Large particles remain in the bed due to the balance between gravity and the upward convection of gas. Small particles are carried out of the bed. In a circulating fluidized bed, some particles of an intermediate size range are separated from the gases exiting the bed by means of a cyclone or other mechanical collector. These collected solids are returned to the bed. Limestone and/or sand is commonly added to the bed to provide a medium for heat and mass transfer. Limestone also reacts with $SO_2$ formed from combustion of the fuel to form $CaSO_4$.

"Coal" refers to a combustible material formed from prehistoric plant life. Coal includes, without limitation, peat, lignite, sub-bituminous coal, bituminous coal, steam coal, anthracite, and graphite. Chemically, coal is a macromolecular network comprised of groups of polynuclear aromatic rings, to which are attached subordinate rings connected by oxygen, sulfur, and aliphatic bridges.

Continuous Emission Monitor ("CEM") refers to an instrument for continuously analyzing and recording the concentration of a constituent in the flue gas of a combustion system; examples of constituents typically measured by CEMs are $O_2$, CO, $CO_2$, $NO_x$, $SO_2$ and Hg.

"Halogen" refers to an electronegative element of group VIIA of the periodic table (e.g., fluorine, chlorine, bromine, iodine, astatine, listed in order of their activity with fluorine being the most active of all chemical elements).

"Halide" refers to a chemical compound of a halogen with a more electropositive element or group.

"High alkali coals" refer to coals having a total alkali (e.g., calcium) content of at least about 20 wt. % (dry basis of the ash), typically expressed as CaO, while "low alkali coals" refer to coals having a total alkali content of less than 20 wt. % and more typically less than about 15 wt. % alkali (dry basis of the ash), typically expressed as CaO.

"High iron coals" refer to coals having a total iron content of at least about 10 wt. % (dry basis of the ash), typically expressed as $Fe_2O_3$, while "low iron coals" refer to coals having a total iron content of less than about 10 wt. % (dry basis of the ash), typically expressed as $Fe_2O_3$. As will be appreciated, iron and sulfur are typically present in coal in the form of ferrous or ferric carbonates and/or sulfides, such as iron pyrite.

"High sulfur coals" refer to coals having a total sulfur content of at least about 1.5 wt. % (dry basis of the coal) while "medium sulfur coals" refer to coals having between about 1.5 and 3 wt. % (dry basis of the coal) and "low sulfur coals" refer to coals having a total sulfur content of less than about 1.5 wt.% (dry basis of the coal).

The term "means" as used herein shall be given its broadest possible interpretation in accordance with 35 U.S.C., Section 11.2, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Micrograms per cubic meter ("$\mu g/m^3$") refers to a means for quantifying the concentration of a substance in a gas and is the mass of the substance measured in micrograms found in a cubic meter of the gas.

Neutron Activation Analysis ("NAA") refers to a method for determining the elemental content of samples by irradiating the sample with neutrons, which create radioactive forms of the elements in the sample. Quantitative determination is achieved by observing the gamma rays emitted from these isotopes.

The term "nitrogen oxide" refers to one or more of nitric oxide (NO) and nitrogen dioxide ($NO_2$). Nitric oxide is commonly formed at higher temperatures and becomes nitrogen dioxide at lower temperatures.

The term normalized stoichiometric ratio ("NSR"), when used in the context of $NO_x$, control, refers to the ratio of the moles of nitrogen contained in a compound that is injected into the combustion gas for the purpose of reducing $NO_x$, emissions to the moles of $NO_x$ in the combustion gas in the uncontrolled state.

"Particulate" refers to free flowing particles, such as finely sized particles, fly ash, unburned carbon, soot and fine process solids, which may be entrained in a gas stream.

Pulverized coal ("PC") boiler refers to a coal combustion system in which fine coal, typically with a median diameter of 100 microns, is mixed with air and blown into a combustion chamber. Additional air is added to the combustion chamber such that there is an excess of oxygen after the combustion process has been completed.

The phrase "ppmw X" refers to the parts-per-million, based on weight, of X alone. It does not include other substances bonded to X.

The phrase "ppmv X" refers to the parts-per-million, based on volume in a gas, of X alone. It does not include other substances bonded to X.

"Separating" and cognates thereof refer to setting apart, keeping apart, sorting, removing from a mixture or combination, or isolating. In the context of gas mixtures, separating can be done by many techniques, including electrostatic precipitators, baghouses, scrubbers, and heat exchange surfaces.

A "sorbent" is a material that sorbs another substance; that is, the material has the capacity or tendency to take it up by sorption.

"Sorb" and cognates thereof mean to take up a liquid or a gas by sorption.

"Sorption" and cognates thereof refer to adsorption and absorption, while desorption is the reverse of adsorption.

"Urea" or "carbamide" is an organic compound with the chemical formula $CO(NH_2)_2$. The molecule has two —$NH_2$ groups joined by a carbonyl (C═O) functional group.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

The Additive

Figure 1:
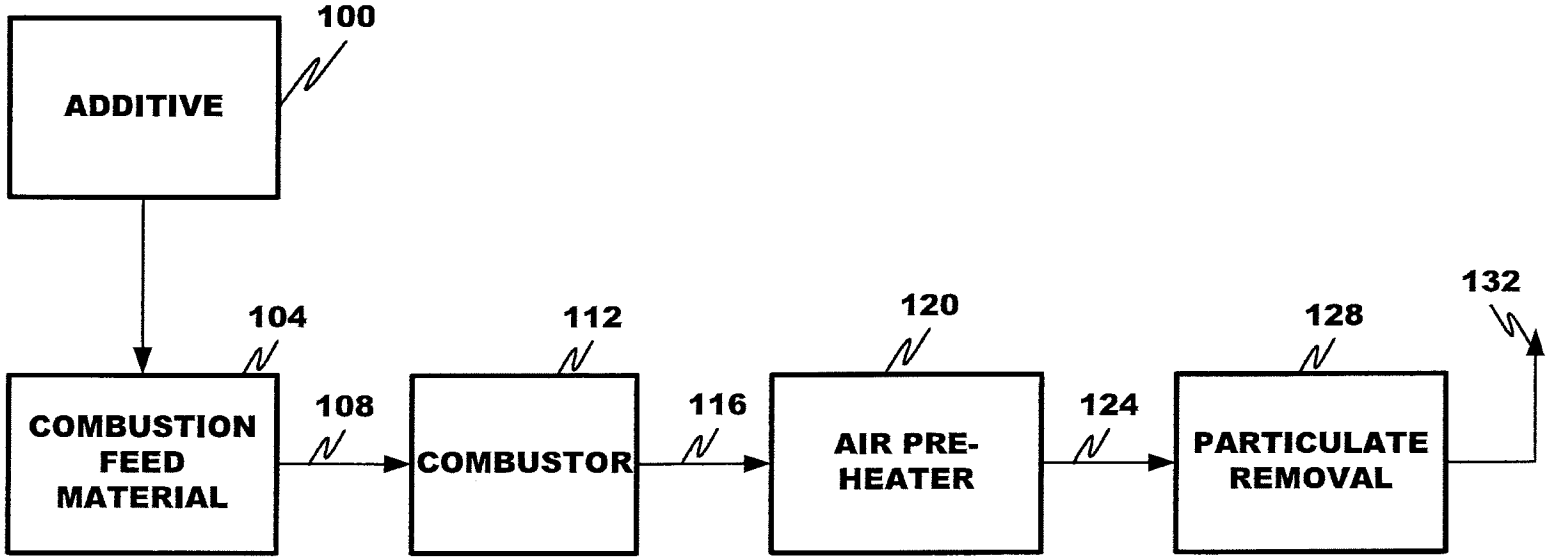
FIG. 1 is a block diagram according to an embodiment showing a common power plant configuration.

The additive comprises at least two components, one to cause removal of nitrogen oxides and the other to cause removal of elemental mercury. The former component uses a nitrogenous material, commonly an ammonia precursor such as an amine and/or amide, while the latter uses a halogen or halogen-containing material.

The additive can contain a single substance for reducing pollutants, or it can contain a mixture of such substances. For example, the additive can contain a a single substance including both an amine or amide and a halogen, such as a haloamine formed by at least one halogen and at least one amine, a halamide formed by at least one halogen and at least one amide, or other organohalide including both an ammonia precursor and dissociable halogen. In an embodiment, the additive comprises an amine or amide. In an embodiment, the precursor composition comprises a halogen. In a preferred embodiment, the precursor composition contains a mixture of an amine and/or an amide, and a halogen.

The Nitrogenous Component

Without being bound by theory, the ammonia precursor is, under the conditions in the furnace or boiler, thermally decomposed to form ammonia gas, or possibly free radicals of ammonia ($NH_3$) and amines ($NH_2$) (herein referred to collectively as "ammonia"). The resulting ammonia reacts with nitrogen oxides formed during the combustion of fuel to yield gaseous nitrogen and water vapor according to the following global reaction:

$$2NO+2NH_3+\tfrac{1}{2}O_2 \rightarrow 2N_2+3H_2O \quad (1)$$

The optimal temperature range for Reaction (1) is from about 1550° F. to 2000° F. Above 2000° F., the nitrogenous compounds from the ammonia precursor may be oxidized to form $NO_x$. Below 1550° F., the production of free radicals of ammonia and amines may be too slow for the global reaction to go to completion.

Commonly, the ammonia precursor is an amine or amide. Sources of amines or amides include any substance that, when heated, produces ammonia gas and/or free radicals of ammonia. Examples of such substances include, for example, urea, carbamide, polymeric methylene urea, animal waste, ammonia, methamine urea, cyanuric acid, and combinations and mixtures thereof. In an embodiment, the substance is urea. In an embodiment, the substance is animal waste.

Commonly at least about 25%, more commonly at least most, more commonly at least about 75%, more commonly at least about 85% and even more commonly at least about 95% of the nitrogenous component is added in liquid or solid form to the combustion feed material. Surprisingly and unexpectedly, it has been discovered that co-combustion of the nitrogenous component with the combustion feed material does not thermally decompose the nitrogenous component to a form that is unable to react with nitrogen oxides or to nitrogen oxides themselves. Compared to post-combustion addition of the nitrogenous component, co-combustion has the advantage of not requiring an injection grid or specific post-combustion injection location in an attempt to provide adequate mixing of the additive with the combustion off-gas, or flue gas. Distribution of the nitrogenous component is not as critical as for post-combustion addition of the component because the additive is added with the combustion feed material and is pre-mixed, and substantially homogeneously distributed, during combustion. Additionally, the nitrogenous component can advantageously be added to the combustion feed material at a remote location, such as prior to shipping to the utility plant or facility.

The nitrogenous component can be formulated to withstand more effectively, compared to other forms of the nitrogenous component, the thermal effects of combustion. In one formulation, at least most of the nitrogenous component is added to the combustion feed material as a liquid, which is able to absorb into the matrix of the combustion feed material. The nitrogenous component will volatilize while the bulk of the combustion feed material consumes a large fraction thermal energy that could otherwise thermally degrade the nitrogenous component. The nitrogenous component can be slurried or dissolved in the liquid formulation. The liquid formulation can include other components, such as a solvent (e.g., water, surfactants, buffering agents and the like), and a binder to adhere or bind the nitrogenous component to the combustion feed material, such as a wax or wax derivative, gum or gum derivative, and other inorganic and organic binders designed to disintegrate thermally during combustion (before substantial degradation of the nitrogenous component occurs), thereby releasing the nitrogenous component into the boiler or furnace freeboard, or into the off-gas. A typical nitrogenous component concentration in the liquid formulation ranges from about 20% to about 60%, more typically from about 35% to about 55%, and even more typically from about 45% to about 50%. In another formulation, at least most of the nitrogenous component is added to the combustion feed material as a particulate. In this formulation, the particle size distribution ($P_{80}$ size) of the nitrogenous component particles as added to the fuel commonly ranges from about 20 to about 6 mesh (Tyler), more commonly from about 14 to about 8 mesh (Tyler), and even more commonly from about 10 to about 8 mesh (Tyler).

Figure 7:
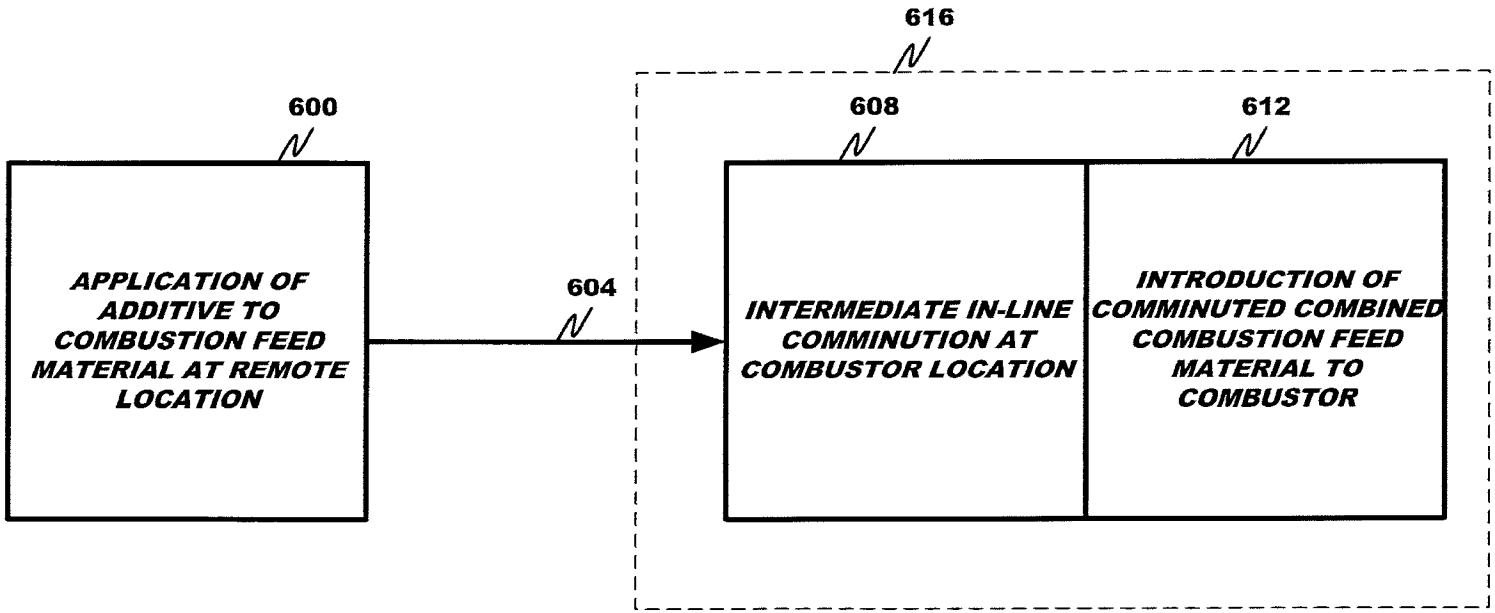
FIG. 7 is a block diagram showing transportation of the combined combustion feed material to the combustor from a remote location according to an embodiment.

With reference to FIG. 7, the combined combustion feed material 108 containing solid nitrogenous particulates are added at a remote location 600, such as a mine site, transported or shipped 604, such as by rail or truck, to the plant site 616, where it is stockpiled in intermediate storage. The combined combustion feed material 108 is removed from storage, comminuted in 608 in-line comminution device to de-agglomerate the particulates in the combined combustion feed material 108, and then introduced 612 to the combustor 112 in the absence of further storage or stockpiling. Such comminution may be accomplished by any of a number of commercial size reduction technologies including but not limited to a crusher or grinder.

In another configuration, the additive particulates are stockpiled at the plant site 616 and further reduced in size from a first size distribution to a more finely sized second size distribution by an in-line intermediate milling stage 608 between storage and addition to the coal feed, which combined combustion feed material 108 is then introduced 612 to the combustor 112 without further storage. In one application, a $P_{80}$ particle size distribution of the additive is reduced from about 6 to 20 mesh (Tyler) to no more than about 200 mesh (Tyler) via in-line milling followed by introduction, without intermediate storage, to the combustor. Typically, a time following in-line milling to introduction to the combustor 112 is no more than about 5 days, more typically no more than about 24 hours, more typically no more than about 1 hour, more typically no more than about 0.5 hours, and even more typically no more than about 0.1 hours. This stage may reduce the particle residence time in the combustion zone. Such milling may be accomplished by any of a number of commercial size reduction technologies including but not limited to jet mill, roller mill and pin mill. Milling of nitrogenous materials is a continuous in-line process since the materials are prone to re-agglomeration. At least a portion of the nitrogenous component will sublime or otherwise vaporize to the gas phase without thermally decomposing. In this formulation, the particle size distribution ($P_{80}$ size) of the nitrogenous component particles as added to the combustion feed material 104 commonly ranges from about 400 to about 20 mesh (Tyler), more commonly from about 325 to about 50 mesh (Tyler), and even more commonly from about 270 to about 200 Mesh (Tyler).

In another formulation, the nitrogenous component is combined with other chemicals to improve handing characteristics and/or support the desired reactions and/or inhibit thermal decomposition of the nitrogenous component. For example, the nitrogenous component, particularly solid amines or amides, whether supported or unsupported, may be encapsulated with a coating to alter flow properties or provide some protection to the materials against thermal decomposition in the combustion zone. Examples of such coatings include silanes, siloxanes, organosilanes, amorphous silica or clays. In yet another formulation, granular long chain polymerized methylene ureas are preferred reagents, as the kinetics of thermal decomposition are expected to be relatively slower and therefore a larger fraction of unreacted material may still be available past the flame zone. Other granular urea products with binder may also be employed. In yet another formulation, the nitrogenous component is supported by a substrate other than a combustion feed material. Exemplary substrates to support the nitrogenous component include zeolites (or other porous metal silicate materials), clays, activated carbon (e.g., powdered, granular, extruded, bead, impregnated, and/or polymer coated activated carbon), char, graphite, (fly) ash, (bottom) ash, metals, metal oxides, and the like. In any of the above formulations, other thermally adsorbing materials may be applied to substantially inhibit or decrease the amount of nitrogenous component that degrades thermally during combustion. Such thermally adsorbing materials include, for example, amines and/or amides other than urea (e.g., monomethylamine and alternative reagent liquids).

The Halogen Component

Compositions comprising a halogen compound contain one or more organic or inorganic compounds containing a halogen or a combination of halogens, including but not limited to chlorine, bromine, and iodine. Preferred halogens are bromine and iodine. The halogen compounds noted above are sources of the halogens, especially of bromine and iodine. For bromine, sources of the halogen include various inorganic salts of bromine including bromides, bromates, and hypobromites. In various embodiments, organic bromine compounds are less preferred because of their cost or availability. However, organic sources of bromine containing a suitably high level of bromine are considered within the scope of the invention. Non-limiting examples of organic bromine compounds include methylene bromide, ethyl bromide, bromoform, and carbonate tetrabromide. Non-limiting sources of iodine include hypoiodites, iodates, and iodides, with iodides being preferred. Furthermore, because various compositions of combustion feed materials may be combined and used, combustion feed materials rich in native halogens may be used as the halogen source.

When the halogen compound is an inorganic substituent, it can be a bromine- or iodine-containing salt of an alkali metal or an alkaline earth element. Preferred alkali metals include lithium, sodium, and potassium, while preferred alkaline earth elements include magnesium and calcium. Halide compounds, particularly preferred are bromides and iodides of alkaline earth metals such as calcium.

There are a number of possible mechanisms for mercury capture in the presence of a halogen.

Without being bound by theory, the halogen reduces mercury emissions by promoting mercury oxidation, thereby causing it to better adsorb onto the fly ash or absorb in scrubber systems. Any halogen capable of reducing the amount of mercury emitted can be used. Examples of halogens useful for practicing the present invention include fluorine, chlorine, bromine, iodine, or any combination of halogens.

While not wishing to be bound by any theory, oxidation reactions may be homogeneous, heterogeneous, or a combination thereof. A path for homogeneous oxidation of mercury appears to be initiated by one or more reactions of elemental mercury. and free radicals such as atomic Br and atomic I. For heterogeneous reactions, a diatomic halogen molecule, such as $Br_2$ or $I_2$, or a halide, such as HBr or HI, reacts with elemental mercury on a surface. The reaction or collection surface can, for example, be an air preheater surface, duct internal surface, an electrostatic precipitator plate, an alkaline spray droplet, dry alkali sorbent particles, a baghouse filter, an entrained particle, fly ash, carbon particle, or other available surface. It is believed that the halogen can oxidize typically at least most, even more typically at least about 75%, and even more typically at least about 90% of the elemental mercury in the flue gas stream.

Under most flue gas conditions, the mercury reaction kinetics for iodine appear to be faster at higher temperatures than mercury reaction kinetics for chlorine or bromine at the same temperature. With chlorine, almost all the chlorine in the flame is found as HCl, with very little Cl. With bromine, there are, at high temperatures, approximately equal amounts of HBr on the one hand and $Br_2$ on the other. This is believed to be why oxidation of Hg by bromine is more efficient than oxidation by chlorine. Chemical modeling of equilibrium iodine speciation in a subbituminous flue gas indicates that, at high temperatures, there can be one thousand times less HI than I (in the form of atomic iodine) in the gas. At lower temperatures, typically below 800° F., diatomic halogen species, such as $I_2$, are predicted to be the major iodine-containing species in the gas. In many applications, the molecular ratio, in the gas phase of a mercury-containing gas stream, of diatomic iodine to hydrogen-iodine species (such as HI) is typically at least about 10:1, even more typically at least about 25:1, even more typically at least about 100:1 and even more typically at least about 250:1.

While not wishing to be bound by any theory, the end product of reaction can be mercuric iodide ($HgI_2$ or $Hg_2I_2$ ), which has a higher condensation temperature (and boiling point) than both mercuric bromide ($HgBr_2$ or $Hg_2Br_2$) and mercuric chloride ($HgCl_2$ or $Hg_2Cl_2$). The condensation temperature (or boiling point) of mercuric iodide (depending on the form) is in the range from about 353 to about 357° C. compared to about 322° C. for mercuric bromide and about 304° C. for mercuric chloride. The condensation temperature (or boiling point) for iodine ($I_2$) is about 184° C. while that for bromine ($Br_2$) is about 58° C.

While not wishing to be bound by any theory, another possible reaction path is that other mercury compounds are formed by multi-step reactions with the halogen as an intermediate.

As will be appreciated, any of the above theories may not prove to be correct. As further experimental work is performed, the theories may be refined and/or other theories developed. Accordingly, these theories are not to be read as limiting the scope or breadth of this disclosure.

Flue Gas Treatment Process Using the Additive

Referring to FIG. 1, an implementation of the additive 100 is depicted.

The combustion feed material 104 can be any carbonaceous and combustion feed material, with coal being common. The coal can be a high iron, alkali and/or sulfur coal. Coal useful for the process can be any type of coal including, for example, anthracite coal, bituminous coal, subbituminous coal, low rank coal or lignite coal. Furthermore, the composition of components in coal may vary depending upon the location where the coal was mined. The process may use coal from any location around the world, and different coals from around the world may be combined without deviating from the present invention.

The additive 100 is added to the combustion feed material 104 to form a combined combustion feed material 108. The amount of additive 100 added to the combustion feed material 104 and the relative amounts of the nitrogenous and halogen-containing components depend on the amount of nitrogen oxides and elemental mercury, respectively, generated by the combustion feed material 104 when combusted. In the former case, commonly at least about 50%, more commonly at least about 100%, and even more commonly at least about 300% of the theoretical stoichiometric ratio of the nitrogenous component required to remove the nitrogen oxides in the off-gas is added to the combustion feed material 104. In many applications, the amount of $NO_x$ produced by combustion of a selected combustion feed material 104 in the absence of addition of the nitrogenous component is reduced commonly by an amount ranging from about 10 to about 50% and more commonly from about 20 to about 40% with nitrogenous component addition.

In absolute terms, the combined combustion feed material 108 comprises commonly from about 0.05 to about 0.5, more commonly from about 0.1 to about 0.4, and even more commonly from about 0.2 to about 0.4 wt. % additive, with the remainder being coal. The mass ratio of the nitrogen: halogen in the additive 100 commonly ranges from about 1:1 to about 2400:1, more commonly from about 7:1 to about 900:1, and even more commonly from about 100:1 to about 500:1.

The additive 100 is commonly added to the combustion feed material 104 prior to its combustion. Given that the combustion feed material 104 can be in any form, the additive 100 can also be in any form convenient for adding to a given combustion feed material 104. For example, the additive 100 can be a liquid, a solid, a slurry, an emulsion, a foam, or combination of any of these forms. The contact of the additive 100 and combustion feed material 104 can be effected by any suitable technique so long as the distribution of the additive 100 throughout the combustion feed material 104 is substantially uniform or homogenous. Methods of combining the additive 100 with the combustion feed material 104 will largely be determined by the combustion feed material 104 and the form of the additive 100. For example, if the combustion feed material 104 is coal and the additive 100 is in a solid form, they may be mixed together using any means for mixing solids (e.g., stirring, tumbling, crushing, etc.). If the combustion feed material 104 is coal and the additive 100 is a liquid or slurry, they may be mixed together using suitable means such as, for example, mixing, stirring or spraying.

The additive 100 may be added to the combustion feed material 104 at a time prior to the fuel being delivered to the combustor 112. Moreover, contact of the additive 100 and combustion feed material 104 can occur on- or off-site. In other words, the contact can occur at the mine where the combustion feed material 104 is extracted or at some point in between the mine and utility, such as an off-loading or load transfer point.

In one application and as discussed above in connection with FIG. 7, the additive 100 is added to the combustion feed material 104 at a physical location different than the location of, or off-site relative to, the combustor 112. By way of example, the additive 100 can be added to the combustion feed material 104 at the site of production of the combustion feed material 104 (e.g., the coal mine). Likewise, the additive 100 can be added to the combustion feed material 104 at a site secondary to the site of production, but that is not the site of combustion (e.g., a refinery, a storage facility). Such a secondary site can be a storage facility located on the property of a combustor 112, for example, a coal pile or hopper located near a combustor 112. In one particular application, the combustion feed material 104 is treated with the additive 100 at a site that is commonly at least about 1,000 miles, more commonly at least about 500 miles, more commonly at least about 10 miles, more commonly at least about 5 miles, and even more commonly at least about 0.25 mile away from the combustor 112.

In some embodiments, the additive 100 is added to the combustion feed material 104 and then shipped to another location or stored for a period of time. The amount of the additive 100 required to reduce the nitrogen oxide is dependent upon the form of the additive 100, whether it be liquid, solid or a slurry, the type of coal and its composition, as well as other factors including the kinetic rate and the type of combustion chamber. Typically the nitrogenous material is applied to the coal feed in a range of 0.05% to 0.75% by weight of the coal. The additive 100 can also comprise other substances that aid in delivery of the nitrogenous material to the combustion feed material 104. For example, the precursor composition may comprise a dispersant that more evenly distributes the additive 100.

The combined combustion feed material 108 is introduced into a combustor 112 where the combined combustion feed material 108 is combusted to produce an off-gas or flue gas 116. The combustor 112 can be any suitable thermal combustion device, such as a furnace, a boiler, a heater, a fluidized bed reactor, an incinerator, and the like. In general, such devices have some kind of feeding mechanism to deliver the fuel into a furnace where the fuel is burned or combusted. The feeding mechanism can be any device or apparatus suitable for use. Non-limiting examples include conveyer systems, hoppers, screw extrusion systems, and the like. In operation, the combustion feed material 104 is fed into the furnace at a rate suitable to achieve the output desired from the furnace.

The target contaminants, namely nitrogen oxides and mercury, volatilize or are formed in the combustor 112. While not wishing to be bound by any theory, nitrogen oxides form in response to release of nitrogen in the coal as ammonia, HCN, and tars. Oxidation of these compounds is believed to produce $NO_x$. Competition is believed to exist between oxidation of nitrogen and conversion to molecular nitrogen. Nitrogen is believed to be oxidized either heterogeneously (which is the dominant oxidation mechanism at off-gas temperatures less than about 1,470° F.) or homogeneously (which is the dominant oxidation mechanism at off-gas temperatures of more than about 1,470° F.). Heterogeneous solid surface catalytic oxidation of nitrogen on limestone is believed to yield NO. In homogeneous gas phase oxidation, ammonia is believed to be oxidized to molecular nitrogen, and HCN to nitrous oxide Gas phase species, such as $SO_2$* and halogen free radicals such as Br* and I*, are believed to increase the concentration of carbon monoxide while decreasing the concentration of NO. Under reducing conditions in the combustion zone, $SO_2$* is believed to be released, and some $CaSO_4$ is converted back to CaO. Reducing conditions normally exist in the bed even at overall fuel lean stoichiometric ratios. NO oxidation to $NO_2$ is believed to occur with gas phase hydrocarbons present and is not reduced back to NO under approximately 1,550° F.

Commonly, at least most of the nitrogen oxides or $NO_x$ are in the form of nitric oxide and, more commonly, from about 90-95% of the $NO_x$ is nitric oxide. The remainder is commonly in the form of nitrogen dioxide. At least a portion of the mercury is in elemental form, with the remainder being speciated. Commonly, target contaminant concentrations in the flue gas 116, in the absence of additive treatment ranges from about 50 to about 500 ppmv for nitrogen oxides and from about 1 to about 40 $\mu g/m^3$ for elemental mercury.

The combustor 112 can have a number of different designs.

Figure 2:
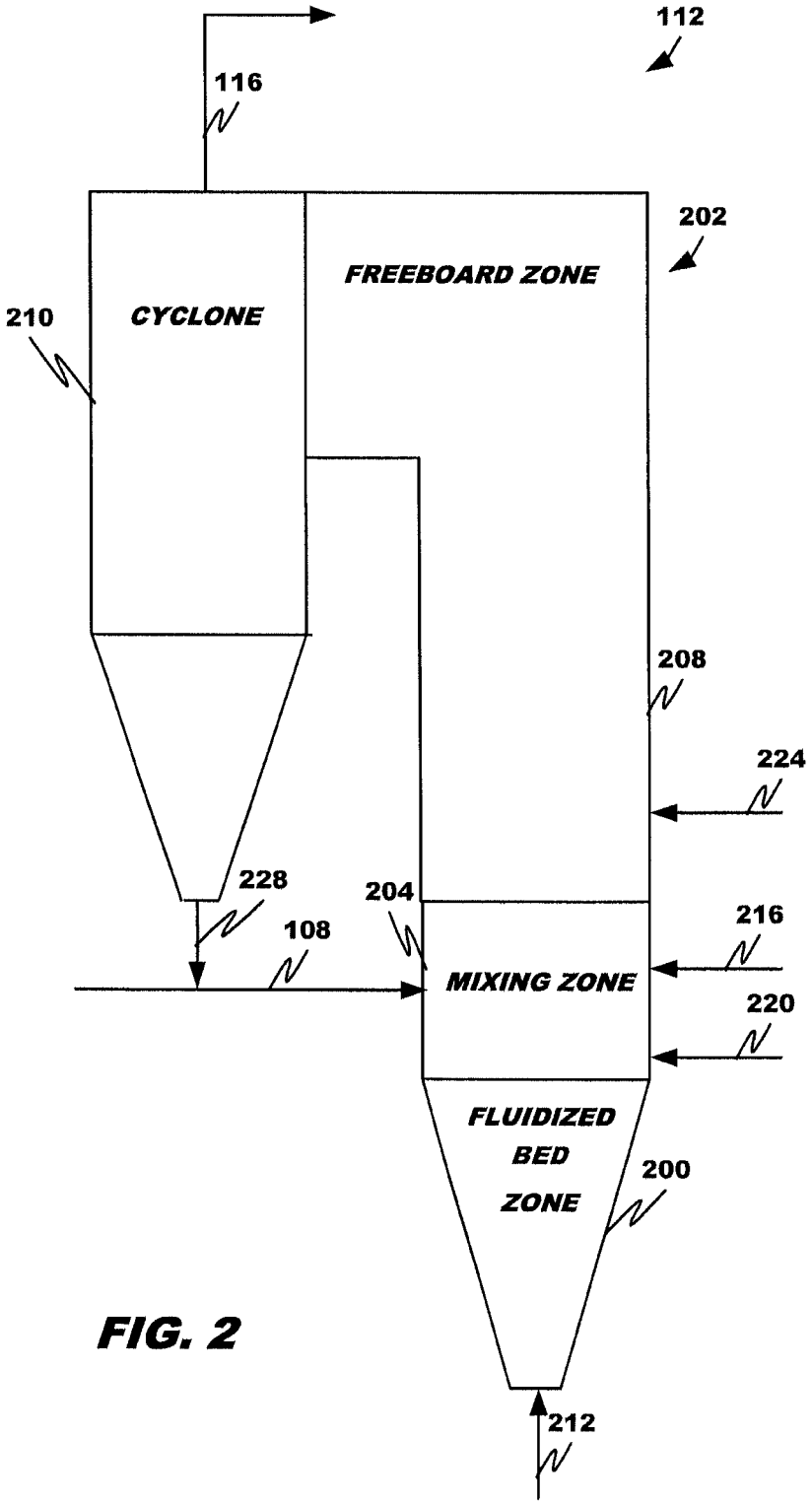
FIG. 2 is a block diagram of a CFB boiler-type combustor according to an embodiment.

FIG. 2 depicts a combustor 112 having a circulating fluidized bed ("CFB") boiler design. The combustor 112 includes a CFB boiler 202 having fluidized bed zone 200 (where larger particulates of coal and additive 100 collect after introduction into the combustor 112), mixing zone 204 (where the introduced combined combustion feed material 108 mixes with upwardly rising combustion off-gases), and freeboard zone 208 (where finely sized particulates of combined combustion feed material 108 and solid partial or complete combustion byproducts are entrained with the flow of the off-gases) combustor sections and a cyclone 210 in fluid communication with the boiler. Primary air 212 enters through the bottom of the boiler to fluidize the bed and form the fluidized bed zone 200. The bed contains not only the combined combustion feed material 108 but also limestone particulates 216, both introduced in the fluidized bed zone 200. The particle $P_{80}$ size distribution for the combustion feed material 104 and 108 particulates commonly ranges from about 325 to about 140_mesh (Tyler) and for the limestone particulates commonly ranges from about 140 to about 6 mesh (Tyler). Secondary air 220 is introduced above the fluidized bed zone 200 and into the freeboard zone 208. Overfire air 224 is introduced into the freeboard 208. The combined combustion feed material 108 further includes (partially combusted or uncombusted) finely sized solid particulates 228 recovered by the cyclone 210 from the off-gas received from the freeboard zone 208. The finely sized solid particulates are typically one or more of uncombusted or partially combusted feed material particulates and/or limestone particulates. Recycled particulates can have an adsorbed amine and/or amide and/or ammonia, which can be beneficial to $NO_x$ reduction. Limestone is used to control emissions of sulfur oxides or $SO_x$. In one configuration, the additive 100 is contacted with the finely sized solid particulates 228 before they are contacted with the combustion feed material 104. Prior to the contact, the combustion feed material 104 may or may not contain the additive. In one configuration, the additive 100 is contacted with the combustion feed material 104 before the combustion feed material 104 is contacted with the finely sized solid particulates 228.

The temperatures in the fluidized bed zone 200 (or combustion zone), and freeboard zone 208 sections varies depending on the CFB design and the combustion feed material. Temperatures are controlled in a range that is safely below that which the bed material could fuse to a solid. Typically, the fluidized bed zone 200 temperature is at least about 1,400° F., more typically at least about 1,500° F., and even more typically at least about 1,550° F. but typically no more than about 1,800° F., more typically no more than about 1,700° F., more typically no more than about 1,650° F., and even more typically no more than about 1,600° F. Typically, the freeboard zone 208 temperature is at least about 1,500° F., more typically at least about 1,550° F., and even more typically at least about 1,600° F. but typically no more than about 1,800° F., more typically no more than about 1,750° F., more typically no more than about 1,600° F., and even more typically no more than about 1,550° F.

The primary air 212 typically constitutes from about 30 to about 35% of the air introduced into the system; the secondary air 220 from about 50 to about 60% of the air introduced into the system; and the remainder of the air introduced into the combustor 112 is the overfire air 224.

In one configuration, additional additive is introduced in the freeboard zone 208, such as near the entrance to the cyclone 210 (where high gas velocities for turbulent mixing and significant residence time in the cyclone are provided). In other configurations, additional additive is introduced into the mixing zone 204 and/or fluidized bed zone 200.

Figure 3:
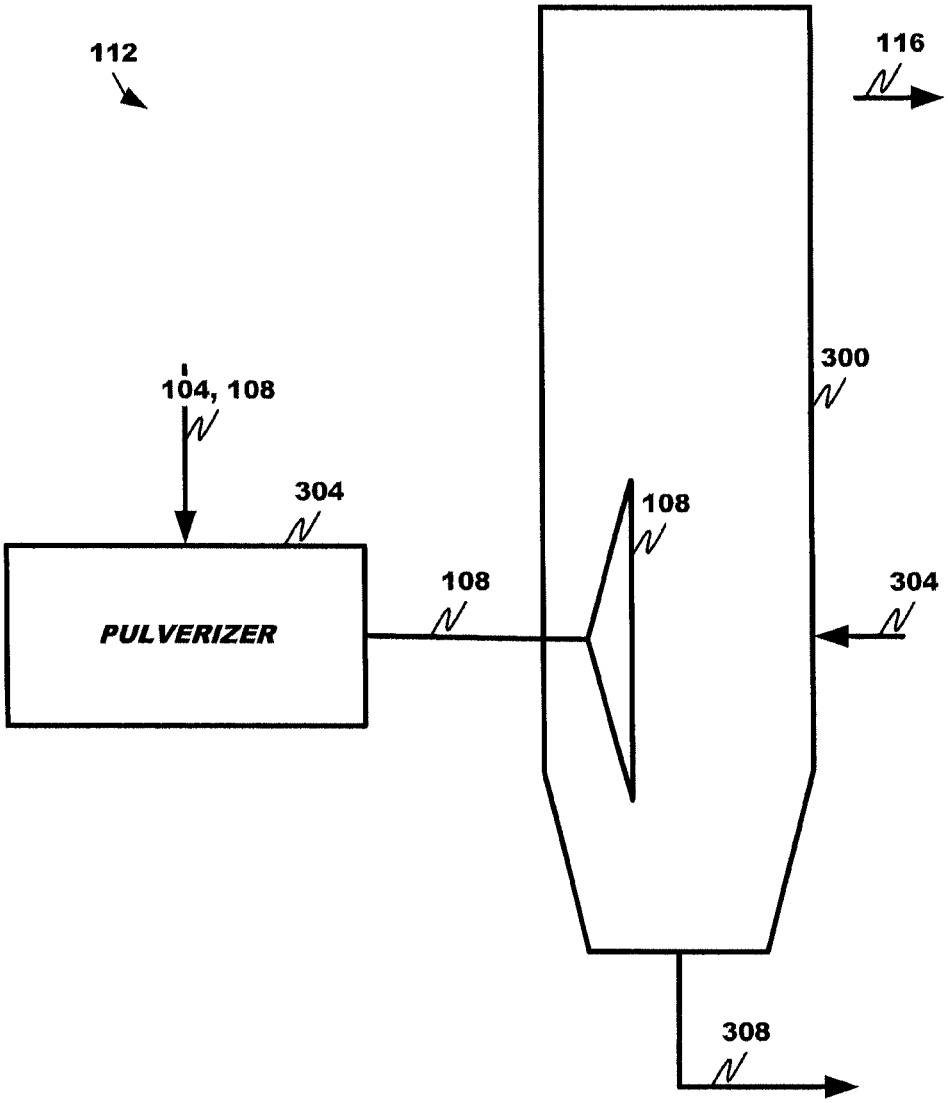
FIG. 3 is a block diagram of a PC boiler-type combustor according to an embodiment.

FIG. 3 depicts a combustor 112 having a pulverized coal boiler ("PC") design. The combustor 112 includes a PC boiler 300 in communication with a pulverizer 304. The combustion feed material 104 or 108 is comminuted in a pulverizer 304 and the comminuted combined combustion feed material 108 introduced, typically by injection, into the PC boiler 300 as shown. The particle $P_{80}$ size distribution for the comminuted combustion feed material 108 particulates commonly ranges from about 325 to about 60 mesh (Tyler). Primary combustion air 304 is introduced into the combustion zone of the PC boiler 300 in spatial proximity to the point of introduction of the pulverized combustion feed material 108. Combustion off-gas or flue gas 116 is removed from the upper portion of the PC boiler 300, and ash or slag 308, the byproduct of coal combustion, from the lower portion of the PC boiler 300. In one configuration, the additive 100 is contacted with the combustion feed material 104 before comminution by the pulverizer 304. In one configuration, the additive 100 is contacted with the combustion feed material 104 during comminution. In one configuration, the additive 100 is contacted with the combustion feed material 104 after comminution.

The temperature in the combustion zone varies depending on the PC boiler design and combustion feed material. Typically, the temperature is at least about 2,000° F., more typically at least about 2,250° F., and even more typically at least about 2,400° F. but no more than about 3,500° F., more commonly no more than about 3,250° F., and even more commonly no more than about 3,000° F.

In one configuration, additional additive is introduced in the upper portion of the PC boiler 300 near the outlet for the flue gas 116 (where high gas velocities for turbulent mixing and significant residence time are provided). In other configurations, additional additive is introduced into the combustion zone in the lower portion of the PC boiler 300.

Returning to FIG. 1, after the combustor 112 the facility provides convective pathways for the combustion off-gases, or flue gases, 116. Hot flue gases 116 and air move by convection away from the flame through the convective pathway in a downstream direction. The convection pathway of the facility contains a number of zones characterized by the temperature of the gases and combustion products in each zone. The combustion off-gases 116 upstream of the air pre-heater 120 (which preheats air before introduction into the combustor 112) is known as the "hot-side" and the combustion off-gases 124 downstream of the air pre-heater 120 as the "cold-side".

Generally, the temperature of the combustion off-gases 116 falls as they move in a direction downstream from the combustion zone in the combustor 112. The combustion off-gases 116 contain carbon dioxide as well as various undesirable gases containing sulfur, nitrogen, and mercury and entrained combusted or partially combusted particulates, such as fly ash. To remove the entrained particulates before emission into the atmosphere, particulate removal systems 128 are used. A variety of such removal systems can be disposed in the convective pathway, such as electrostatic precipitators and/or a bag house. In addition, dry or wet chemical scrubbers can be positioned in the convective pathway. At the particulate removal system 128, the off-gas 124 has a temperature of about 300° F. or less before the treated off-gases 132 are emitted up the stack.

Figure 4:
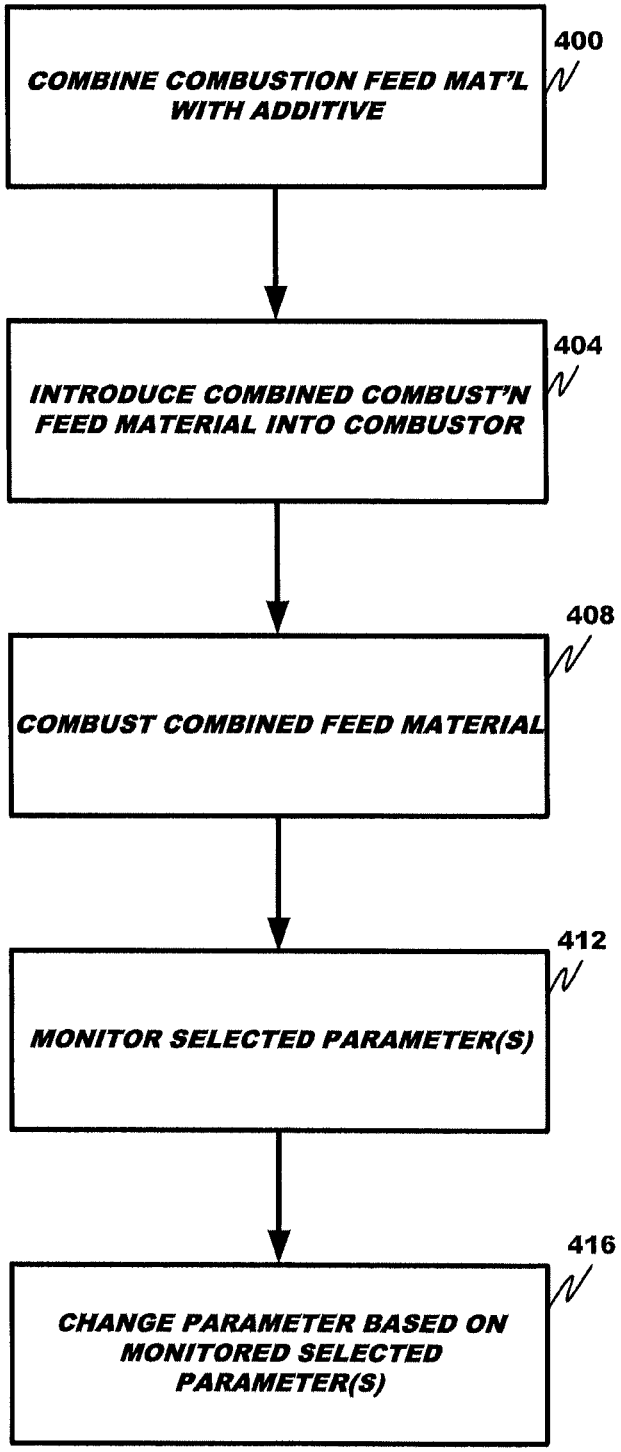
FIG. 4 is a process flow chart according to an embodiment of the disclosure.

A method according to an embodiment of the present disclosure will now be discussed with reference to FIG. 4.

In step 400, the additive 100 is contacted with the combustion feed material 104 to form the combined combustion feed material 108.

In step 404, the combined combustion feed material 108 is introduced into the combustor 112.

In step 408, the combined combustion feed material 108 is combusted in the presence of molecular oxygen, commonly from air introduced into the combustion zone.

In step 412, the combustion and off-gas conditions in or downstream of the combustor 112 are monitored for target contaminant concentration and/or other target off-gas constituent or other parameter(s).

In step 416, one or more selected parameters are changed based on the monitored parameter(s). A number of parameters influence nitrogen oxide and mercury generation and removal. By way of example, one parameter is the rate of introduction of the additive 100. If the rate of addition of additive 100 drops too low, gas phase $NO_x$ levels can increase due to competition between oxidation of additional ammonia and the reaction of ammonia with NO. Another parameter is the gas phase concentration(s) of nitrogen dioxide and/or nitric oxide. Another parameter is the concentration of gas phase molecular oxygen in the mixing zone 204. This parameter controls carbon and additive burnout, $NO_x$ formation, and $SO_x$ capture and decomposition. Another parameter is the temperature in the combustor 112. Higher temperatures in the combustor 112 and lower molecular oxygen concentrations can chemically reduce $NO_x$. Higher combustor temperatures can also decrease gas phase carbon monoxide concentration. Another parameter is gas phase carbon monoxide concentration. Gas phase carbon monoxide concentration in the freeboard zone 208, of the combustor 112 can scavenge radicals and thereby inhibit reactions between the nitrogenous component and $NO_x$. Generally, a negative correlation exists between gas phase CO and NO concentrations; that is, a higher CO concentration indicates a lower NO concentration and vice versa. There further appears to be a negative relationship between gas phase CO concentration and gas phase mercury (total) concentration; that is as CO concentration increases, total mercury concentration decreases. Limestone concentration in the combustor 112 is yet another parameter. Removing catalytic surfaces, such as limestone, can chemically reduce $NO_x$. Gas phase $SO_2$ concentration in the combustor 112 is yet another parameter as it can influence nitrogen oxides. Higher gas phase $SO_2$ concentrations yields a higher gas phase CO concentration, a lower gas phase NO concentration, and higher gas phase nitrous oxide concentration. In CFB combustors, the presence of the nitrogenous component (e.g., urea) makes the fluidized bed zone 200 more reducing so gas phase $SO_2$ concentration increases from decomposition of gypsum, a byproduct of limestone reaction with $SO_x$, and gas phase carbon monoxide concentration increases due to less efficient combustion. Gas phase $SO_2$ concentration increases when limestone flow decreases as well as decreasing NO due to less catalytic surface area. Generally, a negative correlation exists between limestone feed rate and gas phase $SO_2$, CO, and NO concentrations; that is, a higher limestone feed rate indicates lower $SO_2$, CO, and NO concentrations and vice versa. Bed depth and/or bed pressure drop are yet further parameters. These parameters may be controlled by bed drains and control bed temperature; that is a higher pressure drop makes the bed more dense, thereby affecting bed temperature.

Any of these parameters can be changed, or varied (e.g., increased or decreased) to change nitrogen oxide, carbon dioxide, sulfur oxide, and/or mercury emissions in accordance with the relationships set forth above.

Steps 412 and 416 can be implemented manually or by a computerized or automated control feedback circuit using sensors to sense one or more selected parameters, a computer to receive the sensed parameter values and issue appropriate commands, and devices to execute the commands. Microprocessor readable and executable instructions stored on a computer readable medium, such as memory or other data storage, can implement the appropriate control algorithms.

The treated off-gas 132 commonly has substantially reduced levels of nitrogen oxides and mercury compared to the off-gas 116. The additive 100 commonly causes the removal of at least 20% of the gas phase nitrogen oxides and 40% of the elemental mercury generated by combustion of the combustion feed material 104.

Reductions in the amount of a gas phase pollutant are determined in comparison to untreated fuel. Such reductions can be measured in percent, absolute weight or in "fold" reduction. In an embodiment, treatment of fuel with the additive 100 reduces the emission of at least one pollutant by at least about 10%, 20%, 30%, 40%, 50%, 60%, 70%, 80%, 90%, 95% or 100%. In another embodiment, treatment of fuel with the additive 100 reduces the emission of at least one pollutant by two-fold, three-fold, four-fold, five-fold, or ten-fold. In another embodiment, treatment of fuel with the additive reduces the emission of one or more of $NO_x$ and total mercury to less than about 500 ppmv, 250 ppmv, 100 ppmv, 50 ppmv, 25 ppmv, 10 ppmv, 5 ppmv, 4 ppmv, 3 ppmv, 2 ppmv, 1 ppmv, 0.1 ppmv, or 0.01 ppmv. As noted, the pollutant is one or both of nitrogen oxides and total or elemental mercury.

It should be appreciated that the terms amount, level, concentration, and the like, can be used interchangeably. Amounts can be measured in, for example, parts per million (ppm), or in absolute weight (e.g., grams, pounds, etc.) Methods of determining amounts of pollutants present in a flue gas are known to those skilled in the art.

Experimental

The following examples are provided to illustrate certain aspects, embodiments, and configurations of the disclosure and are not to be construed as limitations on the disclosure, as set forth in the appended claims. All parts and percentages are by weight unless otherwise specified.

Figure 5:
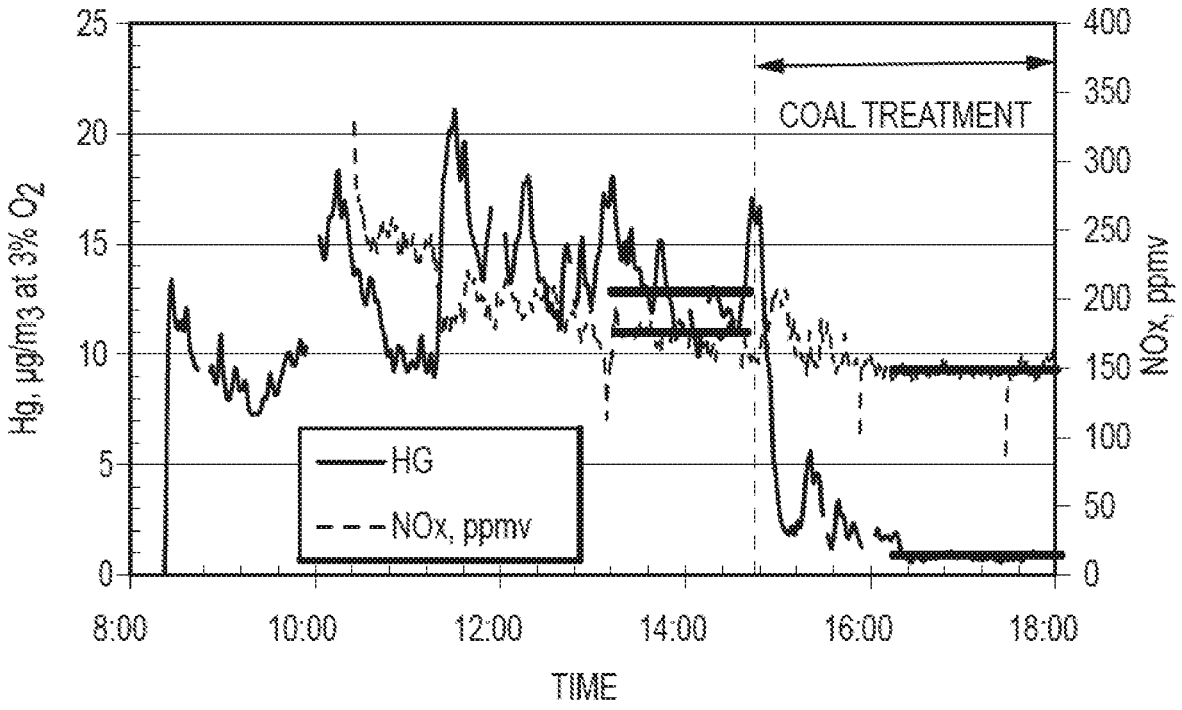
FIG. 5 is a record of the emissions of mercury (Hg) and nitrogen oxides ($NO_x$) measured at the baghouse exit of a small-scale CFB combustor.

In preliminary testing, coal additives were tested at a small-scale circulating fluidized bed (CFB) combustor. Coal was treated by mixing solid urea with crushed coal and by spraying an aqueous solution containing potassium iodide onto crushed coal. Coal was fed into the combustion chamber by means of a screw feeder at a rate of approximately 99 lb/hr. Limestone was not fed continuously but added batchwise to the bed. The only air pollution control device on the combustor was a fabric filter baghouse. The concentrations of nitrogen oxides ($NO_x$) and total gaseous mercury were measured in gas at the baghouse exit using continuous emission monitors (CEMs). The treatment rate of the coal corresponded to 0.0069 lb urea/lb coal and 0.000007 lb iodine/lb coal. The ratio of nitrogen to iodine added on a mass basis was 460 lb nitrogen per lb iodine. FIG. 5 is a record of the emissions of mercury (Hg) and nitrogen oxides ($NO_x$) measured at the baghouse exit during two periods: before the treated coal was added to the boiler and during combustion of the treated coal. The vertical dotted line indicates the time at which the coal started to be treated with the additives. During the baseline (no treatment period), the average emissions of $NO_x$ and Hg were 175 ppmv and 12.9 $\mu g/m^3$, respectively. During a steady-state period of coal treatment, average emissions of $NO_x$ and Hg were 149 ppmv and 0.8 $\mu g/m^3$, respectively. Comparing these two periods, the reductions in $NO_x$ and Hg due to the coal treatment were 14.5% and 93.5%, respectively.

Figure 6:
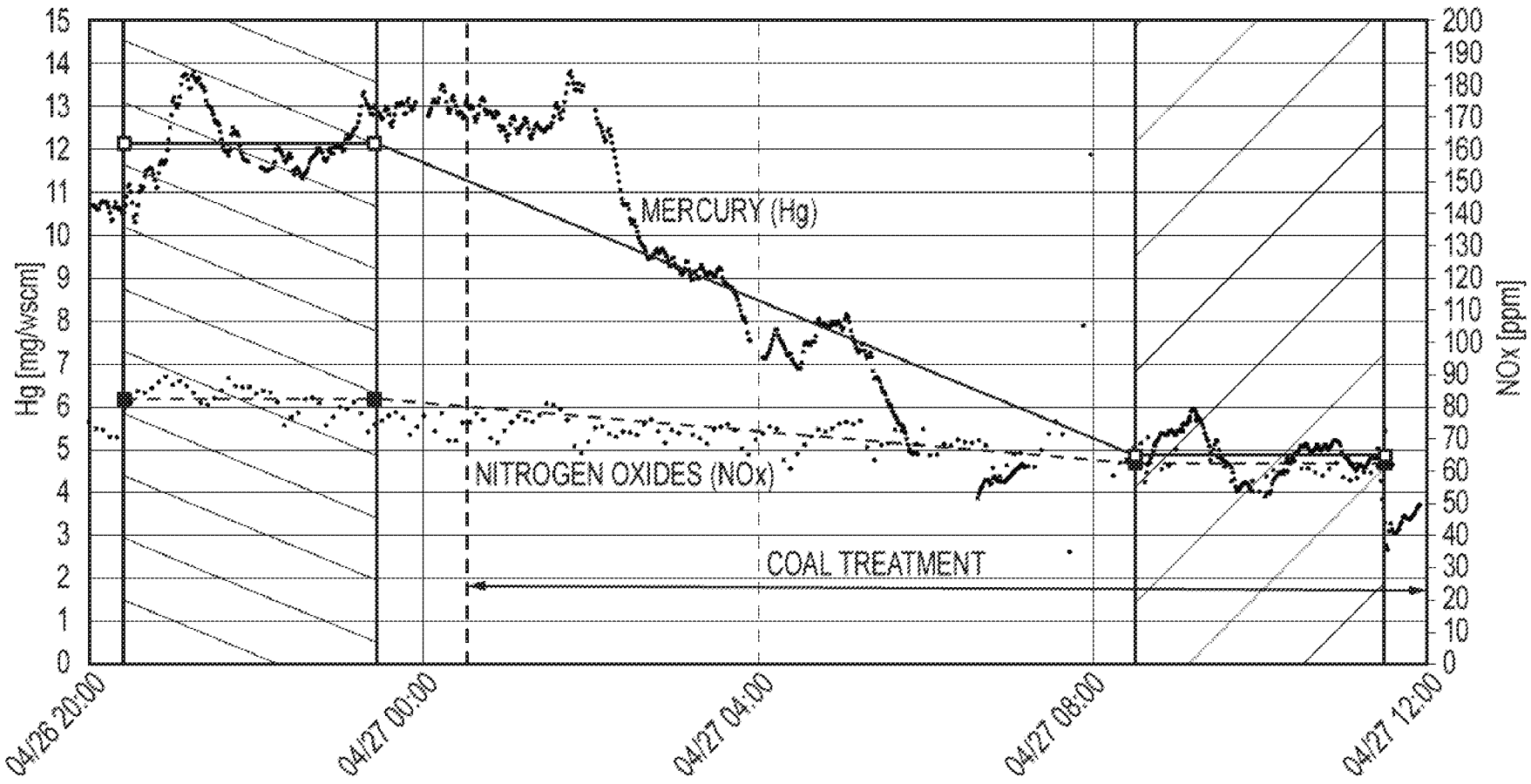
FIG. 6 is a record of the emissions of mercury (Hg) and nitrogen oxides ($NO_x$) measured at the stack of a CFB boiler.

Coal additives were tested at a circulating fluidized bed (CFB) boiler. Coal was treated by adding solid urea prill and by spraying an aqueous solution containing potassium iodide onto the coal belt between the coal crusher and the silos. Coal was fed from the silos directly into the boiler. The boiler burned approximately 190 tons per hour of coal. Limestone was fed into the bed at a rate of approximately 12 tons per hour. The only air pollution control device on the boiler was a fabric filter baghouse. The concentrations of nitrogen oxides ($NO_x$) and total gaseous mercury were measured in the stack using continuous emission monitors (CEMs). The treatment rate of the coal corresponded to 0.0025 lb urea/lb coal and 0.000005 lb iodine/lb coal. The ratio of nitrogen to iodine added on a mass basis was 233 lb nitrogen per lb iodine. FIG. 6 is a record of the emissions of mercury (Hg) and nitrogen oxides ($NO_x$) measured at the stack during two periods: before the treated coal was added to the boiler and during combustion of the treated coal. The vertical dotted line indicates the time at which the coal started to be treated with the additives. The shaded region on the left-hand side of the graph in FIG. 5 represents the baseline (no treatment period), with average emissions of $NO_x$ and Hg of 82.2 ppmv and 12.1 $\mu g/m^3$, respectively. The shaded region on the right-hand-side of the graph represents the steady-state emissions from treated coal, with average emissions of $NO_x$ and Hg of 62.2 ppmv and 4.9 $\mu g/m^3$, respectively. Comparing these two periods, the reductions in $NO_x$ and Hg due to the coal treatment were 24.3% and 60%, respectively.

In another embodiment of the technology, coal additives were tested at a circulating CFB boiler. Coal was treated by spraying a solution consisting of 50% urea in water and by spraying an aqueous solution containing potassium iodide onto the coal belt between the coal crusher and the silos. Coal was fed from the silos directly into the boiler. The boiler burned approximately 210 tons per hour of coal. Limestone was fed into the bed at a rate of approximately 16 tons per hour. The only air pollution control device on the boiler was a fabric filter baghouse. The concentrations of nitrogen oxides ($NO_x$) and total gaseous mercury were measured in the stack using continuous emission monitors (CEMs). The treatment rate of the coal corresponded to 0.0040 lb urea/lb coal and 0.000007 lb iodine/lb coal. The ratio of nitrogen to iodine added on a mass basis was 266 lb nitrogen per lb iodine. During the baseline (no treatment period), the average emissions of $NO_x$ and Hg were 85.2 ppmv and 14.8 $\mu g/m^3$, respectively. During a steady-state period of coal treatment, average emissions of $NO_x$ and Hg were 58.9 ppmv and 7.1 $\mu g/m^3$, respectively. Comparing these two periods, the reductions in $NO_x$ and Hg due to the coal treatment were 30.9% and 51.9%, respectively.

A number of variations and modifications of the disclosure can be used. It would be possible to provide for some features of the disclosure without providing others. The present disclosure, in various aspects, embodiments, and configurations, includes components, methods, processes, systems and/or apparatus substantially as depicted and described herein, including various aspects, embodiments, configurations, subcombinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of forming a treated combustion feed material comprising:

providing a combustion feed material comprising coal; and contacting the combustion feed material with an additive to form a treated combustion feed material, wherein the additive comprises a nitrogenous material that forms ammonia when combusted and a halogen containing material that forms a gas-phase halogen when combusted.

2. The method of claim 1, wherein the nitrogenous material comprises at least one of an amine and an amide and wherein the additive is a free flowing particulate composition having a $P_{80}$ size ranging from about 6 to about 20 mesh (Tyler).

3. The method of claim 1, wherein the nitrogenous material comprises at least one of an amine and an amide and wherein the nitrogenous material is supported by a particulate substrate, the particulate substrate being one or more of the combustion feed material, a zeolite, a porous metal silicate material, a clay, an activated carbon, char, graphite, flyash, a metal, and a metal oxide.

4. The method of claim 1, wherein the nitrogenous material comprises urea.

5. The method of claim 1, wherein a halogen in the halogen-containing material is one or more of iodine and bromine.

6. The method of claim 1, wherein the nitrogenous material is encapsulated with a coating comprising one or more of a silane, a siloxane, an organosilane, and an amorphous silica to impede thermal degradation and/or decomposition of the nitrogenous material.

7. The method of claim 1, wherein the treated combustion feed material comprises from about 0.05 to about 1 wt. % of the additive with the remainder being the coal and wherein the treated combustion feed material comprises a mass ratio of nitrogen:halogen from the additive ranging from about 1:1 to about 2400:1.

8. The method of claim 1, wherein the nitrogenous material is at least one of an amine and an amide and wherein the coal is at least one of a high alkali coal, a high iron coal, and a high sulfur coal.

9. The method of claim 1, wherein the nitrogenous material comprises one or more of an amine and an amide and further comprises a binder to adhere or bind the nitrogenous material to the coal particles, wherein the binder is one or more of a wax, a wax derivative, a gum, and a gum derivative.

10. The method of claim 1, wherein the additive is one or more of a liquid or a slurry and the contacting step comprises spaying the additive onto the combustion feed material.

11. The method of claim 1, wherein the additive is a solid and the contacting step comprises one or more of mixing, stirring, tumbling, and crushing the additive with the combustion feed material to obtain a substantially homogeneous distribution of the additive throughout the treated combustion feed material.

12. A method comprising:

contacting a combustion feed material with an additive composition to form a combined combustion feed material, the additive composition comprising a nitrogenous material encapsulated with a coating comprising one or more of a silane, a siloxane, an organosilane, an amorphous silica, and clay; and combusting the combined combustion feed material to form an off-gas comprising a nitrogen oxide and a derivative of the nitrogenous material, the derivative of the nitrogenous material causing removal of at least a portion of the nitrogen oxide.

13. The method of claim 12, wherein the nitrogenous material comprises at least one of an amine and an amide and wherein the coating impedes thermal degradation and/or decomposition of the nitrogenous material in a combustion zone.

14. The method of claim 12, wherein the nitrogenous material is supported by a particulate substrate, the particulate substrate being one or more of the combustion feed material, a zeolite, a porous metal silicate material, a clay, an activated carbon, char, graphite, flyash, a metal, and a metal oxide.

15. The method of claim 12, wherein the nitrogenous material comprises one or more of an amine and an amide and further comprises a binder to adhere or bind the nitrogenous material to coal particles, wherein the binder is one or more of a wax, a wax derivative, a gum, and a gum derivative.

16. The method of claim 12, wherein the combustion feed material comprises mercury, wherein the additive further comprises a halogen containing material and wherein a mass ratio of nitrogen:halogen from the additive ranges from about 1:1 to about 2400:1.

17. The method of claim 12, wherein the combined feed material comprises from about 0.05 to about 1 wt. % of the additive with the remainder being coal and wherein the coal is at least one of a high alkali coal, a high iron coal, and a high sulfur coal.

18. The method of claim 12, wherein the nitrogenous material comprises at least one of an amine and an amide and wherein the additive is a free flowing particulate composition having a $P_{80}$ size ranging from about 6 to about 20 mesh (Tyler).

19. A combined combustion feed material comprising coal and an additive, the additive comprising a nitrogenous material encapsulated with a coating comprising one or more of a silane, a siloxane, an organosilane, an amorphous silica, and clay.

20. A combined combustion feed material of claim 19, wherein the nitrogenous material is supported by a particulate substrate, the particulate substrate being one or more of the combustion feed material, a zeolite, a porous metal silicate material, a clay, an activated carbon, char, graphite, flyash, a metal, and a metal oxide.

21. A combined combustion feed material of claim 19, wherein the nitrogenous material comprises one or more of an amine and an amide and further comprises a binder to adhere or bind the nitrogenous material to the coal particles, wherein the binder is one or more of a wax, a wax derivative, a gum, and a gum derivative.

22. A combined combustion feed material of claim 19, wherein the combustion feed material comprises mercury, wherein the additive further comprises a halogen containing material and wherein a mass ratio of nitrogen:halogen from the additive ranges from about 1:1 to about 2400:1.

23. A combined combustion feed material of claim 19, wherein the combined feed material comprises from about 0.05 to about 1 wt. % of the additive with the remainder being the coal and wherein the coal is at least one of a high alkali coal, a high iron coal, and a high sulfur coal.

24. A combined combustion feed material of claim 19, wherein the combined feed material comprises from about 0.05 to about 1 wt. % of the additive with the remainder being the coal and wherein the coal is at least one of a high alkali coal, a high iron coal, and a high sulfur coal.

* * * * *